US005299919A

United States Patent [19]

Paul et al.

[11] Patent Number: 5,299,919

[45] Date of Patent: Apr. 5, 1994

[54] FUEL INJECTOR SYSTEM

[76] Inventors: Marius A. Paul; Ana Paul, both of 1120 E. Elm Ave., Fullerton, Calif. 92631

[21] Appl. No.: 885,304

[22] Filed: May 18, 1992

Related U.S. Application Data

[63] Continuation-in-part of Ser. No. 840,839, Feb. 24, 1992, which is a continuation-in-part of Ser. No. 786,286, Nov. 1, 1991.

[51] Int. Cl.[5] ..... F04B 7/08

[52] U.S. Cl. ..... 417/387; 417/499; 417/490; 123/455

[58] Field of Search ..... 417/490, 494, 499, 387, 417/503

[56] References Cited

U.S. PATENT DOCUMENTS

| | | | |
|---|---|---|---|
| 2,251,783 | 8/1941 | Davis | 417/494 |
| 2,282,562 | 5/1942 | Cole | 417/499 |
| 2,397,136 | 3/1946 | French | 417/387 |
| 2,930,323 | 3/1960 | Kessner | 417/387 |
| 3,729,274 | 4/1973 | Hatz et al. | 417/387 |
| 4,577,606 | 3/1986 | Böringer et al. | 417/503 X |

*Primary Examiner*—Richard E. Gluck

*Attorney, Agent, or Firm*—Bielen, Peterson & Lampe

[57] ABSTRACT

A high pressure fuel injector system including a high pressure fuel pump useable with a pressure booster, a pressure stabilizer with a high speed tandem actuated distributor and a fuel having a fuel injector with high pressure fuel admisstion passages and low pressure fuel return passages with a needle valve hydraulically operated by high pressure fuel from the high pressure fuel admission passage by a distributor valve which selectively directs a hydraulic pressure fuel against one side or the other of a piston body forming part of the needle valve whereby the needle valve is urged to a position closing discharge orifices or position opening discharge orifices the distributor valve being controlled by an electronic actuator wherein the injector system is designed with unique floating valve pistons in the components, the components being useable separately or together in the integrated systems preferred for high pressure, high speed operation.

7 Claims, 17 Drawing Sheets

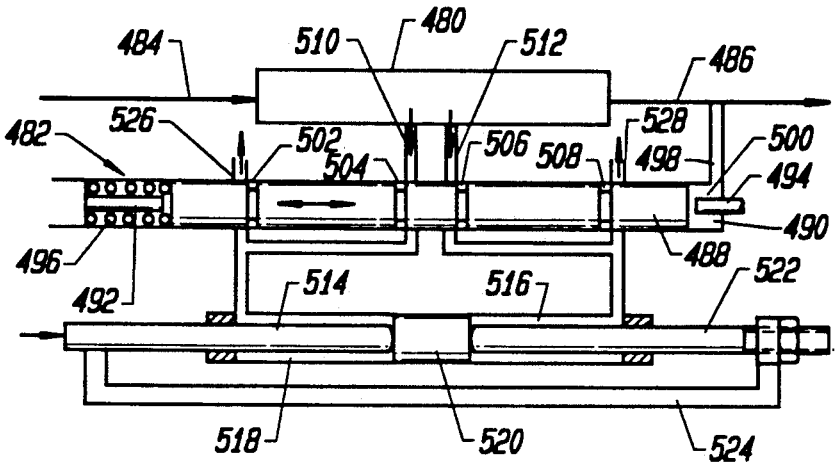
FIG. 19
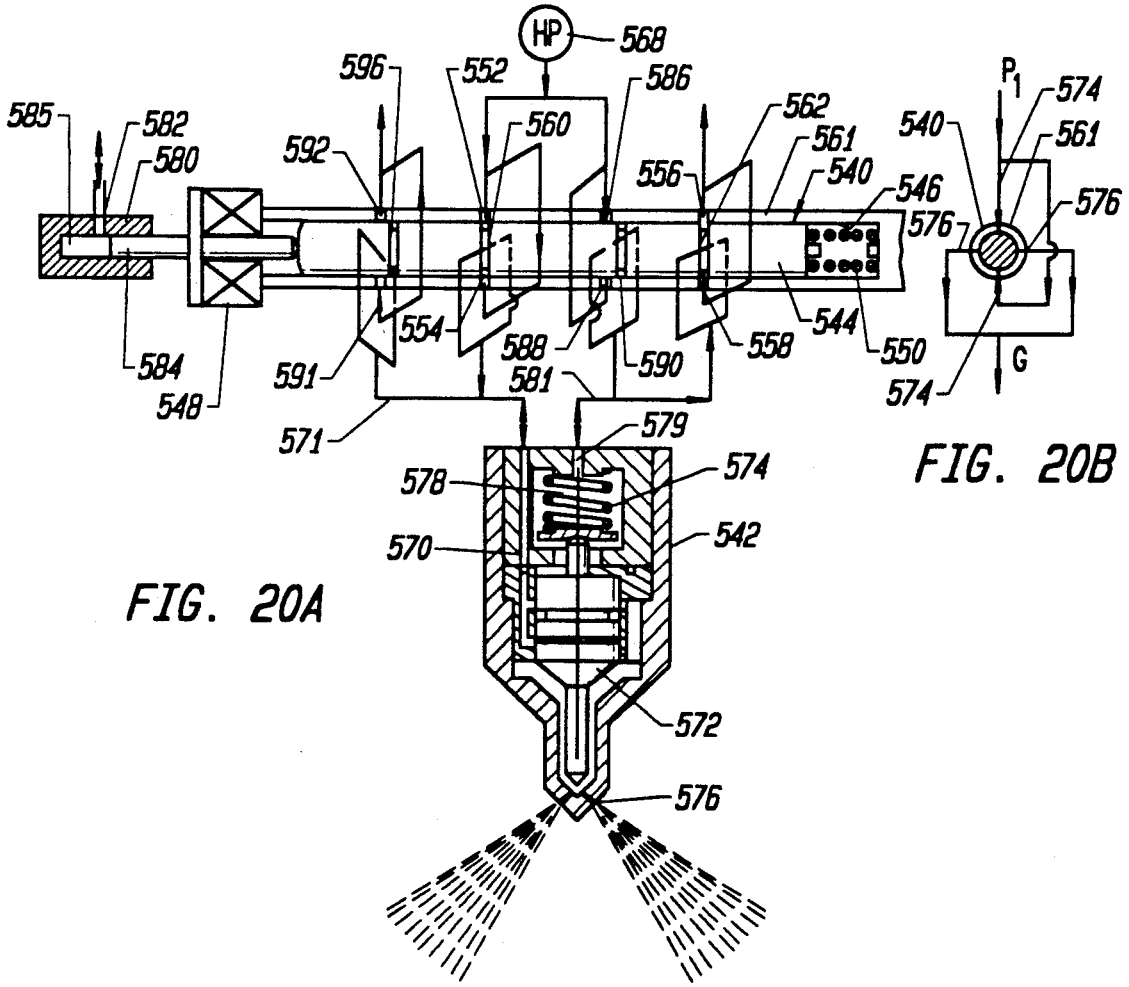
FIG. 20A
FIG. 20B

FUEL INJECTOR SYSTEM

This application is a continuation-in-part of our copending application, Ser. No. 07/840,839, filed Feb. 24, 1992 of the same title, which is a continuation-in-part of our other copending application, Ser. No. 07/786,286, filed Nov. 1, 1991 of the same title.

BACKGROUND OF THE INVENTION

This invention relates to a high pressure fuel injector system that is suitable for high speed engines, particularly those having fuel injection controlled by an electronic fuel injection processor. This invention relates to our fuel injector system described in U.S. Pat. No. 5,042,441, issued Aug. 27, 1991, entitled, "Low Emission Combustion System for Internal Combustion Engines". The fuel injector system of the referenced patent utilizes a high frequency pulsing in order to deliver a pulsed spray to the combustion chamber for fuel efficient combustion. The fuel injection system of the present invention can be adapted to accommodate the pulsed injector feature of our former patent.

In developing fuel injectors for high pressure, high speed engines, fuel economy and low emissions are important considerations. Accurate timing and metering of fuel is essential to achieve these goals. Prior art systems have inherent electronic and mechanical design limitations that render them unworkable for high pressure, high speed systems. In many such systems back pressures and reflected hydraulic pressure waves prevent the injector needle from firm seating and instantaneous cutoff once the fuel delivery cycle has been completed. This results in a lag in the fuel shut-off and leakage of additional fuel into the combustion chamber which is added in an inappropriate time during the engine cycle. This results in smoke from incomplete combustion and wasting of fuel.

In other systems where solenoid actuators are employed, optimum operating speeds must be curtailed because the limits of the response time in conventional electromechanical systems are exceeded. This results in an inability to control the initiation duration or cessation of fuel delivery pulses at high speed engine operation.

In a high speed, high pressure engine, where the combustion chamber is designed for high pressure, high temperature combustion, injection systems must be designed to inject fuel at peak pressures at 200 to 400 atmospheres. The fuel must be metered and injected in an appropriate manner to ensure that the actual fuel delivery coincides with the intended fuel profile. This is particularly important in electronic fuel delivery systems where the operating conditions are monitored electronically and fuel is metered according to engine performance and demand under control of a preprogrammed computer control processor.

In multiple cylinder engines or in engines having one or more cylinders with multiple fuel injectors, it is customary to include a rail supply, which is essentially a high pressure fuel injector manifold, situated between the high pressure fuel injector pump and the fuel injectors. The rail supply holds a volume of high pressure fuel and operates as a surge control for modulating or buffering the periodic pulsing of the injectors. However, the high frequency pulsing of fuel released into the cylinders results in reflected pressure waves in the rail supply and other hydraulic components that appears to inhibit the fuel injector needle valve from seating and thereby fully closing the discharge orifices of the injector nozzle. In such a situation the actual fuel pulse has a long tail or injection dribble which is untimely to the operating cycle of the engine. Injection tail or leak results in incomplete complete combustion and pollution in the form of sooty or high carbon smoke.

The improved high pressure fuel injector of this invention eliminates post injection leak and cuts the trailing tail of the injection cycle at the point desired. The improved design enables substantial control over the injection cycle and renders the design of the fuel injector to be particularly applicable to electronically controlled fuel systems where the timing of the injector pulse can be varied electronically according to a predetermined system program.

For high speed operation, in excess of 5000 r.p.m., the conventional electronic activation systems fail to respond quick enough to the cycle demand. As electronic systems generally rely on solenoid-type actuators, the time required to energize the coil for electromagnetically forcing displacement of the core, or de-energizing the core to enable retraction by a bias means may lag the cycle demands. This will result in a truncate fuel pulse profile and fuel starvation. By use of a novel tandem coil system with dual hydraulic distributor valves fuel can be delivered with a sharply defined fuel pulse with a flow profile having a steep slope at pulse initiation and cutoff, and a controllable profile during injection.

The high pressure fuel delivery components are designed to enable integration of select components into a fuel injection system that satisfies the operating requirements of various levels of performance from enhanced conventional engines where only improved fuel efficiency or reduced pollution is desired to super high performance engines where high speed, high pressure operation is required.

The principals of the original design are applicable to mechanical designs for pulsed spray injection as shown in the added material in this continuation-in-part application. In addition, to the prevention of fuel dribble from delayed seating on closure, the designs prevent excess wear attributed to alternate designs where the injector components are subjected to high pressure differentials on cycling.

SUMMARY OF THE INVENTION

The improved high pressure fuel injector system of this invention is designed to eliminate the common phenomena called dribbling in which the injector nozzle fails to cease delivering fuel after the timed cycle pulse has completed. Prolonged fuel pulse tail at the post injection stage results in improper combustion with attendant pollution. The high carbon discharge gases may result in carbonization or coking of the injector nozzle tip causing the orifice size to shrink or causing distortion of the spray pattern for the fuel. The post injection fueling results from the inability of the injector needle to properly seat within the injector nozzle as a result of pressure spikes that result primarily from deflected pressure waves in the high pressure fuel supply components during injection cutoff. In general, the nozzle needle is pressed against a valve seat within the end of the nozzle by a spring. The force of the seating is generally determined by the supplied force of the compression spring with hydraulic forces from the high pressure fuel supply neutralized. Localized pressure peaks, however, can overcome the spring pressure and inhibit immediate cutoff of fuel injection by the fuel injector. These pressure peaks are traced primarily to the supply rail or accumulator where reflected pressure waves act to lift the needle valve.

In the improved high pressure fuel injector developed by applicants, an internal distributor valve directs the full pressure of the high pressure fuel supply against the back of the needle valve to insure an instantaneous and sharp cutoff of fuel injection after the programmed fuel pulse has been completed. The high pressure fuel injector of this invention can be integrated into any conventional injector system with either a mechanically or electronically controlled actuation.

In its preferred application, the high pressure fuel injector has an electronically controlled servo-system actuating a hydraulic distributor valve to sequentially direct the hydraulic force of the highly pressurized fuel for actuation of the needle valve in the injector nozzle for a smooth opening and a short and sharp closing. Because both of the actions on the needle valve are effected by the full constant pressure of the high pressure fuel supply, the opening and closing process is absolute.

The structural design of the high pressure injector utilizes the high pressure fuel supply to retain the injector in a closed position by acting on an enlarged segment of the back side of the needle valve to force the closure of the needle greatly exceeding combustion chamber pressures acting on the end of the needle valve or low pressure hydraulic pressures acting on the front side of the needle valve. Any pressure fluctuations in the high pressure fuel supply are directed at the top or backside of the needle valve. The tendency for the needle to lift is thereby totally eliminated. With the ability to precisely control the pulse of actual injection, the designed injector is particularly suitable for electronically controlled systems where pulse duration and pulse configuration can be varied in response to engine operating conditions.

In addition, the system is suitable for embodiments in which the timed pulse for an operating cycle can be multiplexed into a timed series of high frequency, micropulses within each cycle pulse. This feature can be accomplished electronically as described in the referenced patent or as disclosed with reference to one of the preferred embodiments of this invention. As disclosed herein, a mechanical means is constructed in which an induced hydraulic instability is effected to provide a series of needle lift oscillations within the duration of the timed injection pulse. Utilizing micro multiple injection pulses during a controlled injection period permits control of the heat release within the engine cylinder and enables optimization of fuel economy and pollution reduction.

The enhanced capabilities of the improved injector also make the injector suitable for multifuel capability with the injector being programmable for a variety of liquid fuels. Furthermore, by minor alterations in the size of the discharge orifices of the injector nozzle, the improved injector can be utilized for gaseous as well as liquid fuels. In certain embodiments, the improved high pressure fuel injector includes nozzle tips with orifice designs that utilizes multiple tangential nozzle orifices that in conjunction with the shape of the needle tip and needle seat, generates a super high rotation and dispersion to the discharging spray. These designs result in an efficient mix of the fuel spray with the compressed air in the combustion chamber for effective atomization and clean combustion. With the utilization of a constricted conical spaces between the specially configured needle valve tip and the needle seat, the preferred tangential nozzle holes can be larger then conventional size enabling the total injection time to be shortened and the liklihood of orifice blockage to be reduced. This feature is particularly important in high rotation engines where the injection period is minimized at the very time fuel demand is maximized.

The various features here described combine to provide an improved fuel injector suitable for lower pressure spark ignited engines or advanced, hyperbar diesel engines.

In the improved design, the injector nozzle and the injector distributor or pulse generator are separate components to enable a more flexible design and enable a streamline configuration to be used for the nozzle component. In addition, the injector design is applicable, with minor modification for pulsing by mechanical hydraulic means without the use of ultrasonic transducers.

The components described are designed for implementation in existing engine systems individually or in various combinations and are particularly designed for integration into an injection system useable for high speed and/or high pressure applications including cycled combustion engines or continuous combustion engines with internal or external combustion systems. The injections system is designed to enable complete control over the fuel injection process at all speeds and loads of engine operation. The injection system is particularly adaptable to electronically controlled engine operation where operation conditions and parameters are sensed and monitored and fuel injection is closely controlled for instant response to demand, load, or fuel efficiency. The system is designed to produce a predesigned and predictable fuel injection profile that matches the desired profile for programmable operation of an electronically controlled engine.

BRIEF DESCRIPTION OF THE DRAWINGS

FIG. 19 is a schematic illustration of a pressure regulator.

FIG. 20A is a schematic illustration of a fuel distributor.

FIG. 20B is a schematic illustration of an end portion of the distributor of FIG. 20A.

DESCRIPTION OF THE PREFERRED EMBODIMENTS

Figure 1:
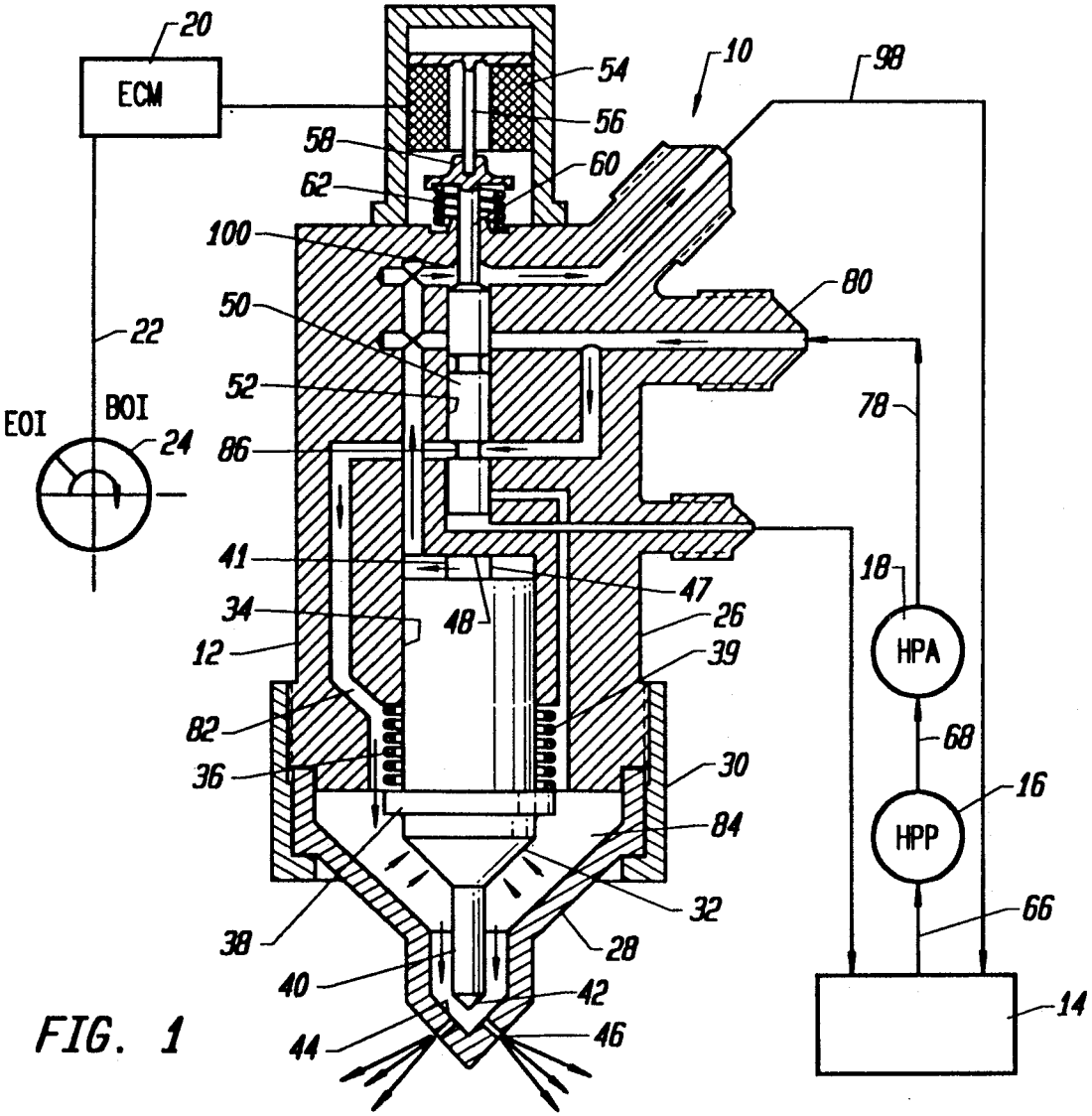
FIG. 1 is a cross-sectional view of the improved high pressure fuel injector in a fuel injector system with the valve needle of the injector in an open position during fuel injection.

Referring now to FIG. 1, a high pressure fuel injector system, designated generally by the reference numeral 10 is shown partly schematically. In one embodiment, the fuel injector system 10 includes a high pressure fuel injector 12 with a fuel reservoir 14. The fuel reservoir 14 supplies a high pressure fuel pump 16 that delivers fuel to a high pressure accumulator 18 which in turn supplies one or more injectors of the type shown in FIG. 1. The injector 12 may be cam operated or operated by other mechanical means. It is preferred, however, that the injector 10 be controlled by an electronic control module 20. The electronic control module 20 has an input feed line 22 that at least senses the cycle cf operation of the engine 24 for controlling the timing of the injection pulse. The input line 22 can comprise a network of electronic sensors that monitors the engine operating conditions and provides data to the electronic control module 20 for optimized control of the fuel injector 12 pursuant to a programmed procedure as is known in the out of electronic engine control systems.

Figure 2:
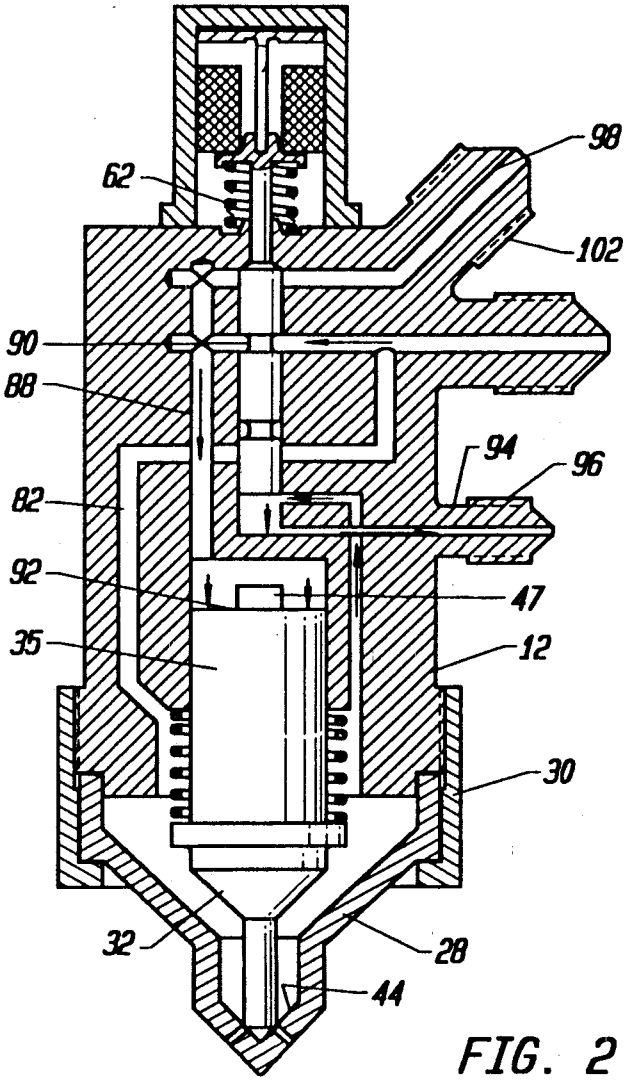
FIG. 2 is a cross-section view of the injector of FIG. 1 with the valve needle in a closed position blocking fuel injection.

The fuel injector 12, also shown in the cross-sectional view of FIG. 2, includes a injector body 26 having a series of supply and return passages for fuel delivery, and, the necessary bores for the valving of the discharge as detailed hereafter. A replaceable nozzle 28 is connected to the injector body 26 by a joint nut 30 and together with the body 26 houses an axially displaceable valve needle 32 having a piston body 35 with a back end 37. The valve needle 32 is freely displaceable in a central bore 34 in the injector body 26. The valve needle is biased by a compression spring 36. The compression spring 36 seats against a flange 38 on the valve needle 32 and against a rim 39 on the bore 34. The bore of the injector body and back end 37 of the piston body 35 form a hydraulic chamber 41 that alternately communicates with the low pressure reservoir or high pressure accumulator 18. The valve needle 32 has a tip 40 that has a conical end 42 which seats against the conical inside wall 44 of the nozzle 28 blocking the discharge orifices 46, when seated as shown in FIG. 2. The valve needle 32 is hydraulically displaceable in the bore 34, from the retracted position shown in FIG. 1, where stop 47 contacts the bore end 48, to the extended position shown in FIG. 2, where the end 42 of the tip 40 firmly contacts the inner conical wall 44 of the nozzle 28.

Displacement of the valve needle 32 is controlled by positioning of the distributor valve 50 which is axially displaceable in a bore 52 in the injector body 26. Displacement of the distributor valve 50 is controlled by a solenoid 54, which has an axially displacable armature 56. The armature 56 engages a cap 58 on the end extension 60 of the distributor valve 50 and displaces the distributor valve 50 on displacement of the armature 56. The distributor 50 is maintained in a position that blocks discharge of fuel from the injector 12 on deactivation of solenoid 54 by a compression spring that seats between a cap 58 on an end extension 60 on the distributor valve 50 and a depression 62 in the injector body 26. The distributor valve 50 opens and closes fuel passages during operation of the valve and allows a pulsed supply of fuel to the discharge orifice in the nozzle.

In operation, fuel is drawn from the reservoir 14 by the pump through a supply line 66 where it is passed through a high pressure line 68 to the high pressure accumulator 18, which may comprise a supply rail or manifold for multiple fuel injectors or a small high pressure reservoir that acts as a buffer or surge for a single injector. From the accumulator 18, a high pressure line 78 connects with the fuel input nipple 80 on the injector body 26. The fuel input line 78 bifurcates with one passage forming a discharge line 82 that supplies a plenum 84 in the injector nozzle 28. In FIG. 1, the distributor valve 50 is displaced to position a constricted section 86 at the passage 82 to permit fuel flow through the passage. In this position, the high pressure fuel in the plenum 84 of the nozzle 28 hydraulically acts on the nozzle tip 40 including the nozzle flange 38 forcing the compression spring 36 to compress and the nozzle needle to displace to the position as shown in FIG. 1 In such position, the passage to the discharge orifices 46 is clear allowing unrestricted injection of fuel through the orifices.

Displacement of the distributor valve 50 is accomplished by electronically activating the solenoid 54 to draw down the linear armature 56 and displace the distributor valve 50 against the bias of the compression spring 62. When the solenoid 54 is deactivated, the compression spring 62 automatically displaces the armature 56 and the distributor valve 50 to the position shown in FIG. 2. In this position, the discharge line 82 is blocked and the alternate needle actuation line 88 is opened by positioning of the axially concentric groove constriction 90 in the distributor valve 50 to open the actuation line 88, allowing high pressure fuel from the accumulator 18 to be directed against the enlarged back end 92 of the valve needle 32. This pressurized fuel hydraulically forces the needle 32, in a manner of a hydraulic piston, such that the end 42 of the needle 32 seats firmly against the inner wall 44 of the nozzle 28. In this position, as shown in FIG. 2, the distributor valve 50 has positioned itself such that discharge line 82 is blocked and a small pressure relief line 94 is opened to the low pressure reservoir 14. A substantial pressure differential enables an overwhelming force to be applied against the nozzle orifices such that peak pressures during combustion have no effect on the positioning of the valve needle. Fluctuations in the high pressure fuel supply are totally directed at the enlarged back end of the valve needle 32 directed toward closure and not opening through relief line nipple 96. The diameter of the back of the valve needle is many times larger than the needle tip, particularly where exposed to the discharge orifices 46.

Upon actuation of the fuel injector, the valve needle 32 is retracted as shown in FIG. 1, and an actuation return line 98 is opened by positioning the distributor valve 50 such that a reduced diameter neck 100 of the end extension 60, opens the return line 98. Fuel from the hydraulic activating chamber 104 behind the valve needle 32 escapes through return line 98 and nipple 102 to the low pressure reservoir 14. With the excape of fuel behind the valve needle 32, the full force of the hydraulic pressure in the supply fuel can act upon the front of the valve needle 32 to force it into its retracted position as shown in FIG. 1.

Figure 4:
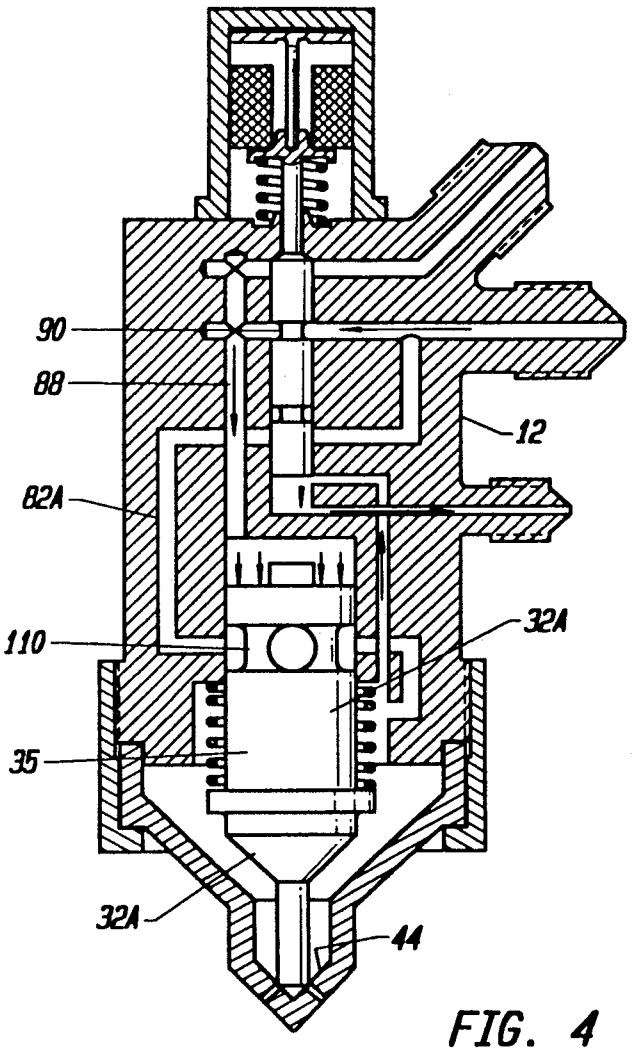
FIG. 4 is a cross sectional view of the injector of FIG. 3 with the valve needle in a closed position blocking fuel injection.
Figure 3:
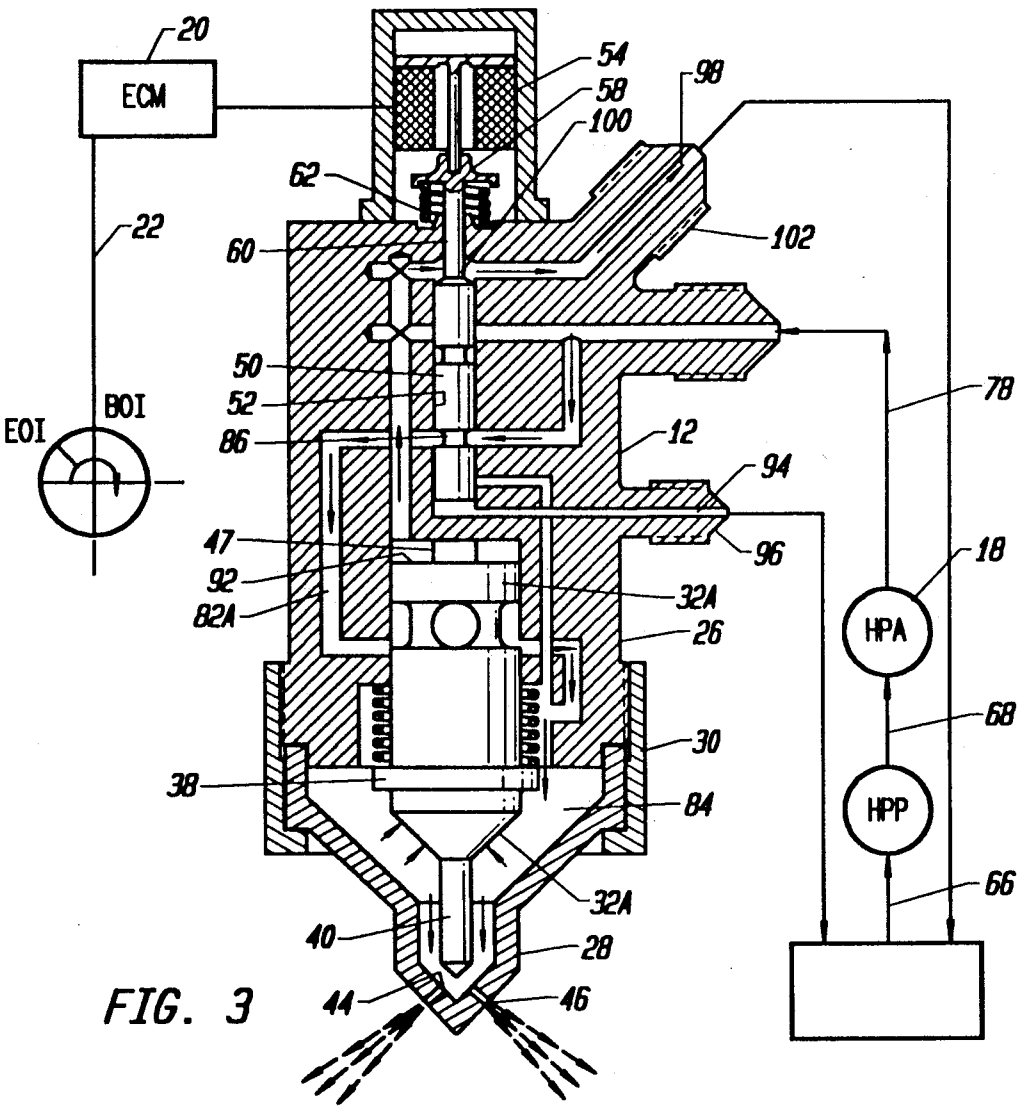
FIG. 3 is an alternate embodiment of the high pressure fuel injector system with the valve needle of the fuel injector in an open position during fuel injection.

Referring now to the alternate embodiment of FIGS. 3 and 4, a minor modification in the construction of the valve needle **32*a* produces a deliberate flutter or oscillation to the needle 32 to repeatedly expose and block the discharge orifices 46. This action provides a series of high frequency micropulses during each timed injection cycle pulse for improved combustion. As shown in FIG. 3, the high pressure fuel injection system 10 includes the same essential components as in the previous embodiment with a fuel reservoir 14, a high pressure pump 16, a high pressure actuator 18, and a fuel injector 12. The injector 12 is actuated by an electric control module 20 that monitors the operating conditions of the engine 24 through an input line 22 for creating the primary cycle pulse for the injector. The valve needle 32*a* has a constricted section 110 in the enlarged piston body 41 that is positionable in line with an altered route discharge line 82*a*. On displacement of the armature 56 on actuation of the solenoid 54 to connect the high pressure fuel line 78 to the discharge line 82*a* through the distributor valve 50 the plenum 84 in the nozzle 28 the valve needle 32*a* is caused to lift. This action causes the needle 32*a* to retract sufficiently as shown in FIG. 3, to substantially block the discharge line 82*a* such that the fuel in the plenum partially discharges. The resulting pressure drop allows the valve needle to return to the closed position whereupon discharge line 82*a* is again opened permitting free-flow of fuel to the plenum and forcing retraction of the needle valve. This unstable state causes a high frequency oscillation that results in a multipulsation of microjets that generates an ultra high atomization of the fuel with a gradual heat release and reduced combustion temperature. As noted in our prior U.S. Pat. No. 5,042,441 this fuel discharge profile can also be obtained electronically by electronic manipulation of a fuel injector of the type shown in FIGS. 1 and 2**.

Figure 5:
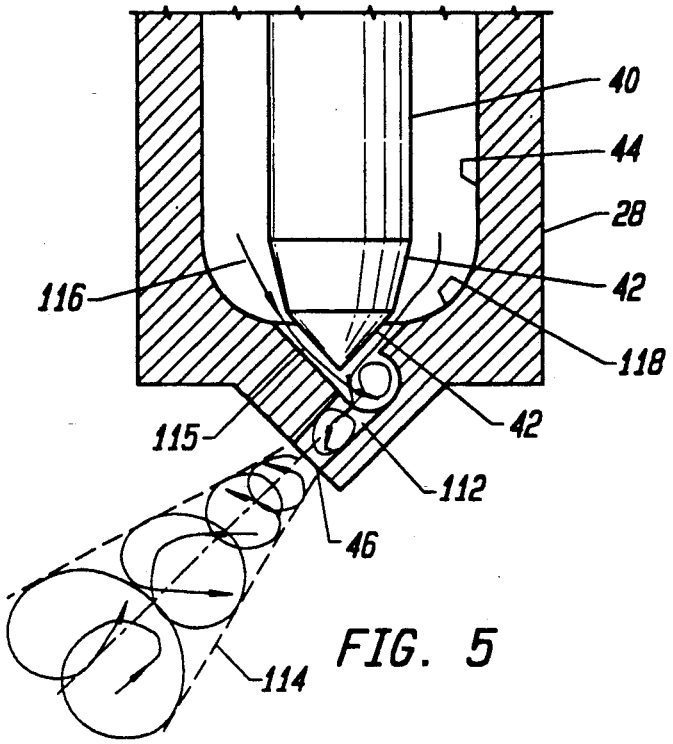
FIG. 5 is an enlarged cross-sectional view, partially fragmented of a fuel injector nozzle tip useable in the injectors of FIGS. 1 and 3.

With reference to FIG. 5, the preferred configuration of the nozzle 28 and orifice 46 upon actuation is shown. In this configuration, an orifice 46 having a tangentially arranged hole 112 causes the discharged fuel to swirl and generate a turbulent spray pattern 114 as shown schematically in FIG. 5. A supply passage 115 is formed between the needle tip 40 and the inner wall 44 of the nozzle 28. The end 42 of the nozzle has a taper 116 and the wall 44 has a dished portion 118 to provide substantially unconstricted flow to the conically constricted zone 120 between the tip end 42 and the conical segment of the nozzle wall 44. This constricted zone 120 regulates the acceleration of fuel flow such that the tangential orifice holes 112 can be oversized to iniate dispersion.

Figure 6:
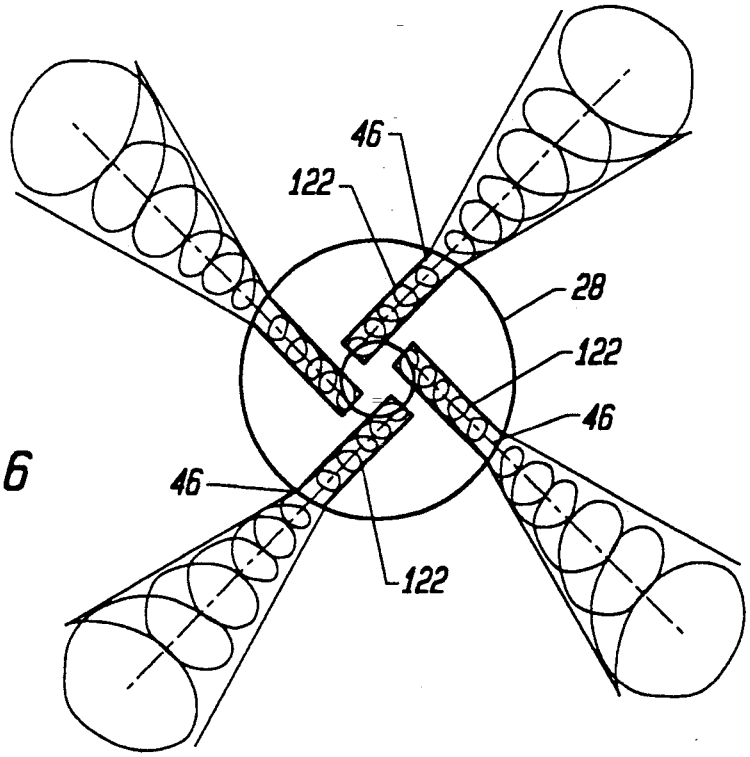
FIG. 6 is an enlarged end view, of an alternate fuel injector nozzle tip.

In a similar manner, the nozzle 28 of FIG. 6 includes multiple orifices 46 with multiple holes 122 that are tangentially oriented to the conical interior wall of the nozzle 28. This arrangement is particularly suitable for an injector positioned axially along the center line of an engine cylinder.

Figure 7:
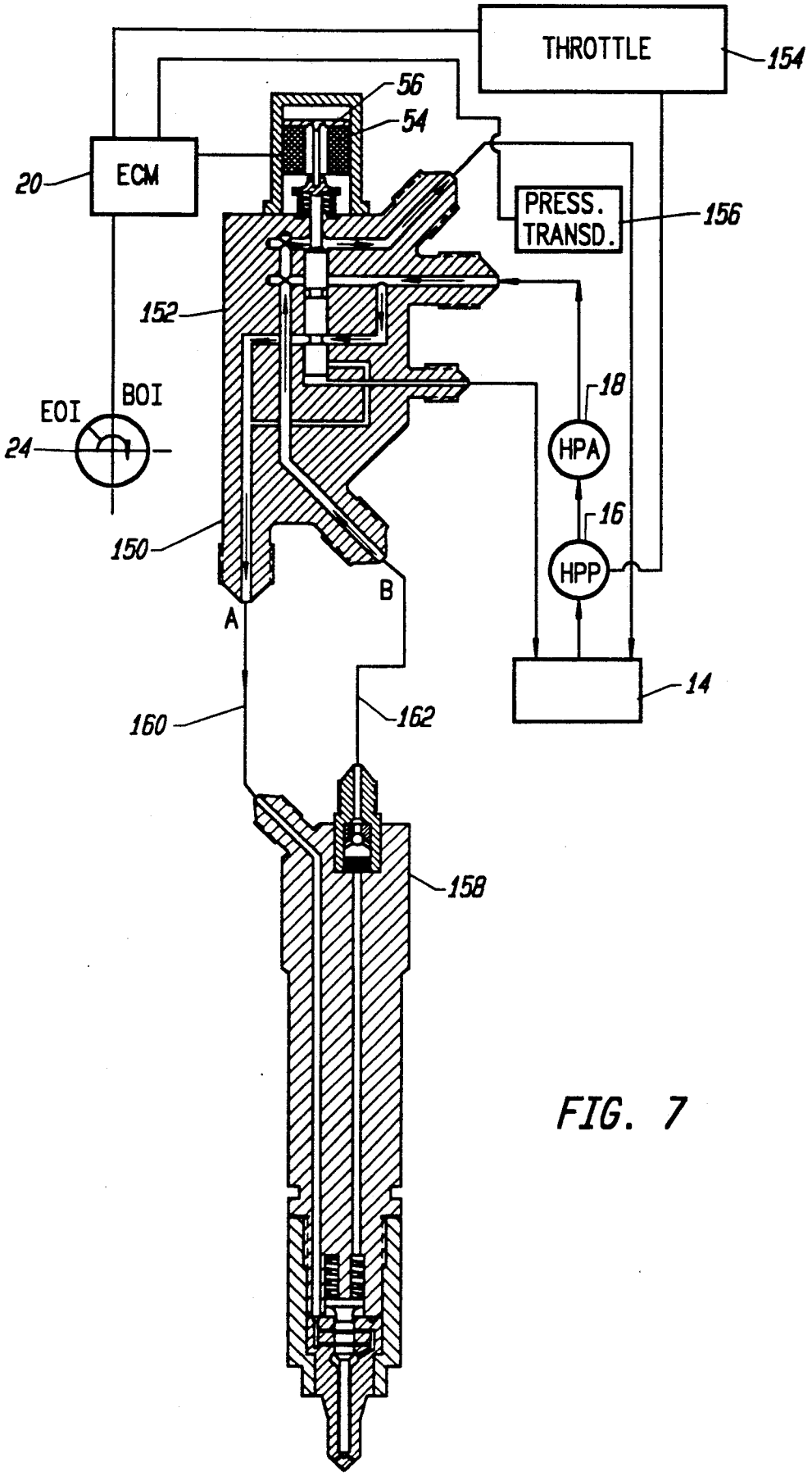
FIG. 7 is a cross sectional view and combined schematic of the dual component fuel injector.

Referring now to FIG. 7, the alternate, high pressure, fuel injector system 150 includes many of the components of the previously described injector system 10. The alternate system includes an engine 24 having means for signaling engine timing to an electronic control module 20 for operating the solenoid 54 and armature 56 of a distributor component 152 in the fuel injector system 150. Additional input to the electronic control module 20 is transmitted from the engine throttle 154 and from a pressure sensing transducer 156. The throttle 154 monitors the engine performance and demand by the user. The pressure transducer 156 monitors the delivery pressure to the hydraulic distributor component 152 from the high pressure accumulator 18. The throttle 154 regulates the high pressure pump 16 and insures that there will be sufficient fuel pumped to the accumulator 18 when the distributor component is activated by the electronic control module 20. Fuel is drawn from a fuel reservoir 14 which is of lower pressure than the accumulator 18. The reservoir 14 may be pressurized by a low pressure fuel pump from an atmospheric supply (not shown).

The hydraulic distributor component 152 delivers and returns high pressure fuel to a nozzle component 158. The nozzle component 158 is connected to the hydraulic distributor component 152 by high pressure hydraulic lines 160 and 162. The nozzle component 158 is designed to produce a pilot pulse and a main injection pulse during each cycle of the distributor component. The nozzle component 158 is primarily designed to be used with the distributor component of FIG. 7 singly or in tandem for high speed engine operation. Alternately, the nozzle component can be utilized with any existing distributor component, typically for lower pressure engine operations.

Figures 8A, 8B:
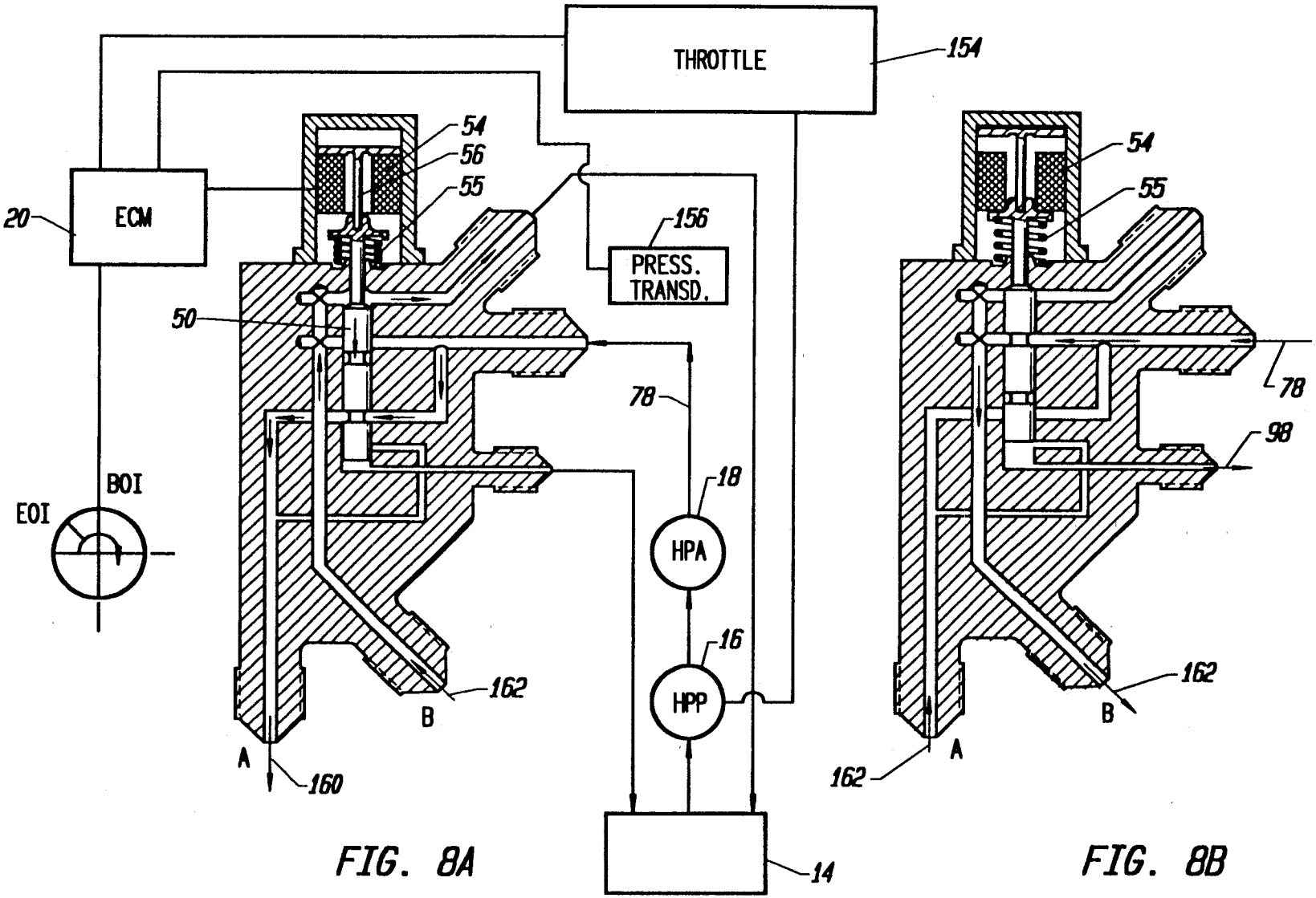
FIG. 8A is a cross sectional view and combined schematic of the hydraulic distributor component of the fuel injector of FIG. 1 which is an injection mode.
FIG. 8B is a cross sectional view and combined schematic of the hydraulic distributor component of the fuel injector of FIG. 1 which is a non-injection mode.

Referring now to FIGS. 8A and 8B, the operation of the distributor component can be considered. When an actuating signal is received from the electronic control module 20 to actuate the armature 56 in the solenoid 54, to displace the distributor valve 50, a pulse of high pressure fuel from the high pressure accumulator 18 passes through a supply line 78 and through distributor valve 50 to nozzle feed line 160.

When no signal is transmitted by the electronic control module 20, the solenoid 54 is not energized allowing the armature 56 to be retracted by force of a compression spring 55. In such case, the high pressure fuel passes through distributor valve 50 in a passage that delivers the high pressure to the nozzle component 158 through feed line 162. Fuel in the nozzle plenum is returned through line 62 on closure of the nozzle for ultimate return to the reservoir 14 through return line 98. The operation is similar to the hydraulic distributor elements of the previous embodiments of FIGS. 1 and 2.

Figure 10:
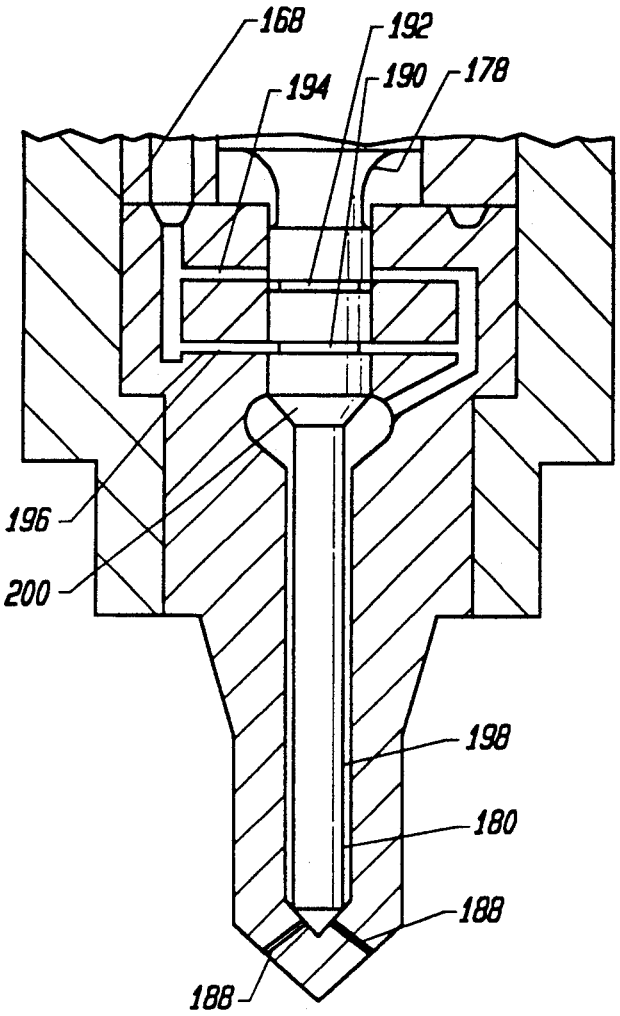
FIG. 10 is an enlarged, partial view of the nozzle tip of the nozzle component of FIG. 9.
Figure 9:
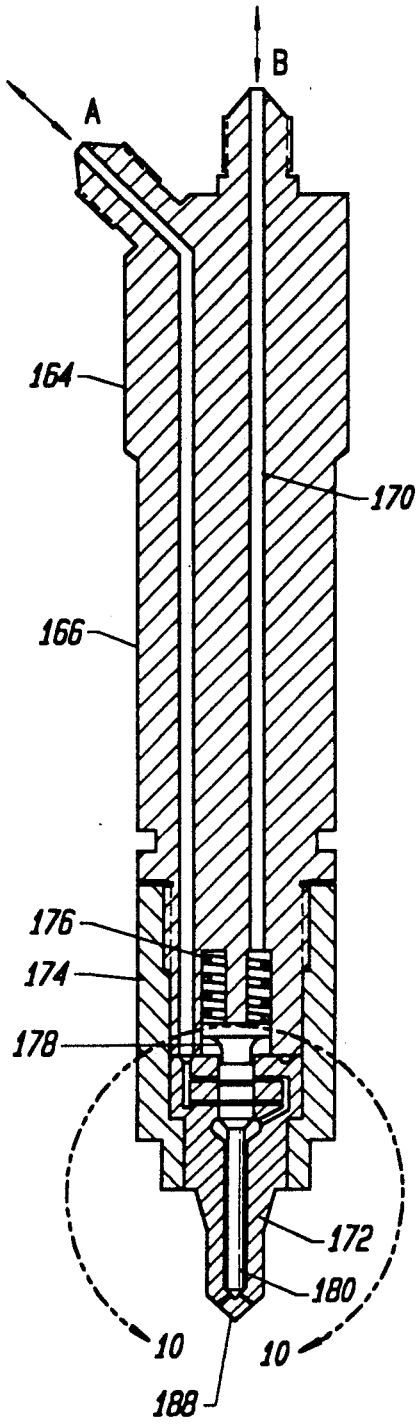
FIG. 9 is a cross sectional view of an alternate nozzle component of the fuel injector of FIG. 1.
Figure 11:
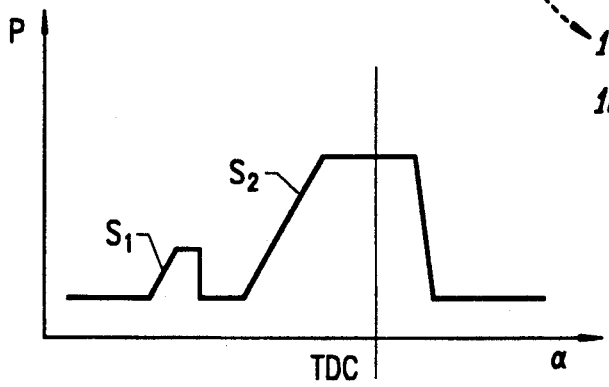
FIG. 11 is a diagrammatic view of the pulse pattern of the nozzle component of FIG. 9.

A more simply constructed, alternate nozzle component 164 is shown in FIG. 9 in the same orientation as the primary nozzle component 158. The nozzle component has an elongated body 166 with duel supply and return passages 168 and 170 which alternately function to supply and return fuel from the accumulator 18 and reservoir 14. Coupled to the nozzle body is a nozzle tip 172 which is secured by a stepped tip nut 174. Although the slide valve 178 is designed with two axially concentric grooves or bypass channels 190 and 192, the slide valve could be designed with one or more additional bypass channels with or without the addition of alignable supply passages in addition to passages 194 and 196 shown in FIG. 10. When high pressure fuel is fed through line 168, supply line 196 communicates with needle plenum 198 hydraulically acting against the slide valve shoulder 200 to displace the slide valve against the compression spring 176 providing for a pulse of fuel being discharged through nozzle orifice 188. The discharge is abruptly cut when bypass channel 190 displaces from alignment with supply passage 196. Until bypass channel 192 becomes aligned with supply passage 194, a hiatus in the discharge spray occurs. Once bypass channel 192 and supply passage 194 are aligned, the primary pulse proceeds. This pilot injection and subsequent main injection assumes a pulse pattern on angular cycling of the engine as shown in FIG. 11.

Figure 12:
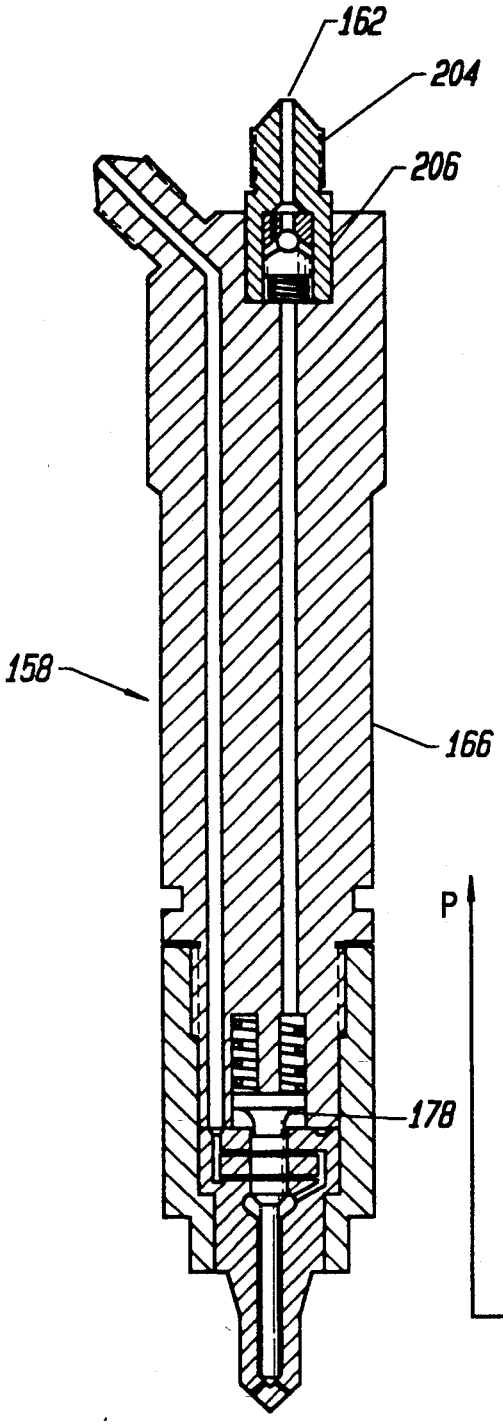
FIG. 12 is an enlarged view of the nozzle component of the fuel injector of FIG. 1.
Figure 13:
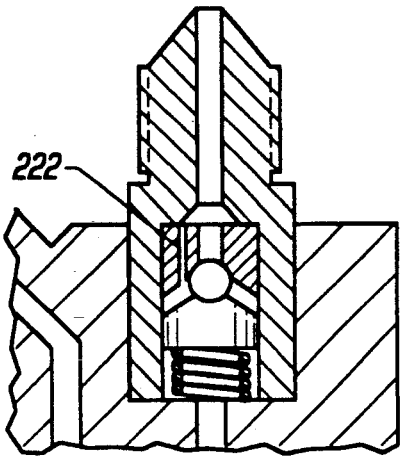
FIG. 13 is an enlarged partial view of the flow valve in the nozzle component of FIG. 12.
Figure 14:
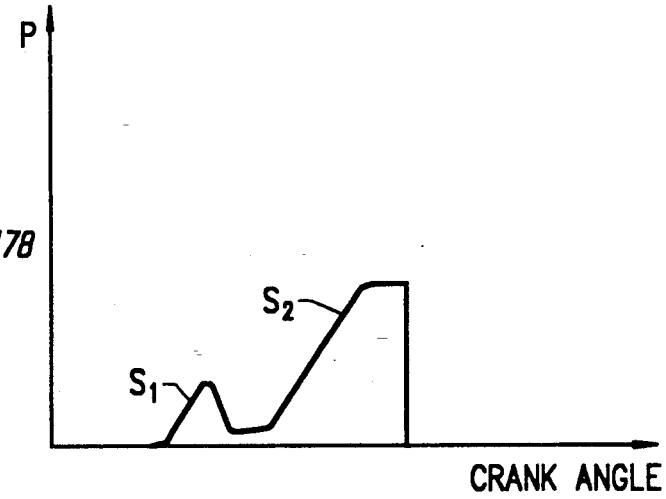
FIG. 14 is a diagrammatic view of the pulse pattern of the nozzle component of FIG. 12.

As shown in FIGS. 12, 13, and 14, the pulse pattern can be modified by the inclusion of a relief valve 204 in the fuel line 162. Preferably, the relief valve 204 is a double acting valve to provide a smooth sloped pilot pulse and a gradually increasing main pulse that is abruptly terminated, as shown in the pressure diagram of FIG. 14. The relief valve 204 includes both a ball valve 210 supported by a slider 212, which is biased to closure by a compression spring 214. The relief valve is designed to operate as a check valve in one direction, providing a large flow rate through passage 162 to force the ball valve 210 against the slider 212, opening the passage for sharp closure of the needle tip 180 as the high pressure hydraulic fuel presses against the back of the slide valve 178 of the needle valve. In operation in the opposite direction, the flow return is restricted by the small passage 222 acting as a flow restricter. The passage 222 restricts the flow through the valve 204 when fuel is returned through line 162. This acts to reduce the lifting speed of the needle 198 of the injector nozzle 158 producing a more gradual, incline slope S1 and S2 at the beginning of injection of the pilot pulse and main pulse as shown in FIG. 14.

Figure 15A:
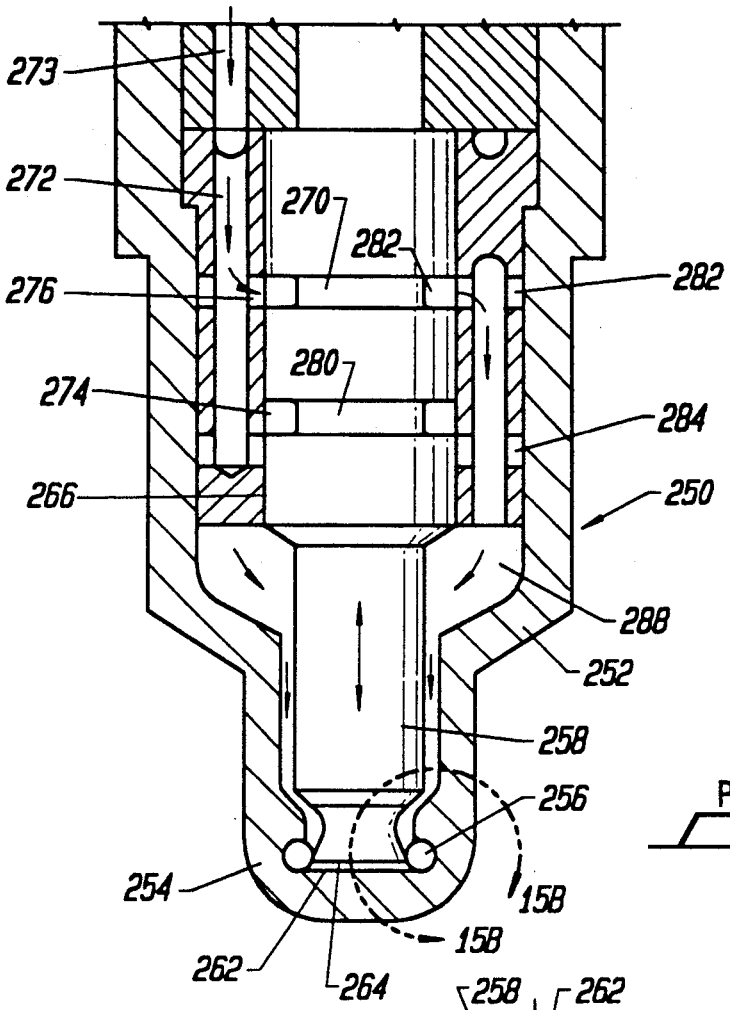
FIG. 15A is an enlarged, partial, cross-sectional view of another alternate fuel injector nozzle tip.
Figure 15C:
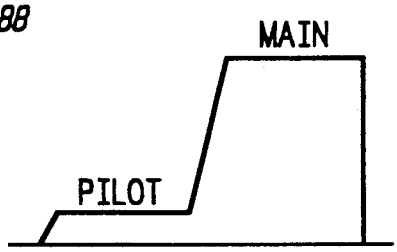
FIG. 15C is a schematic diagram of an injection profile developed from injector tip in FIG. 15A.
Figure 15B:
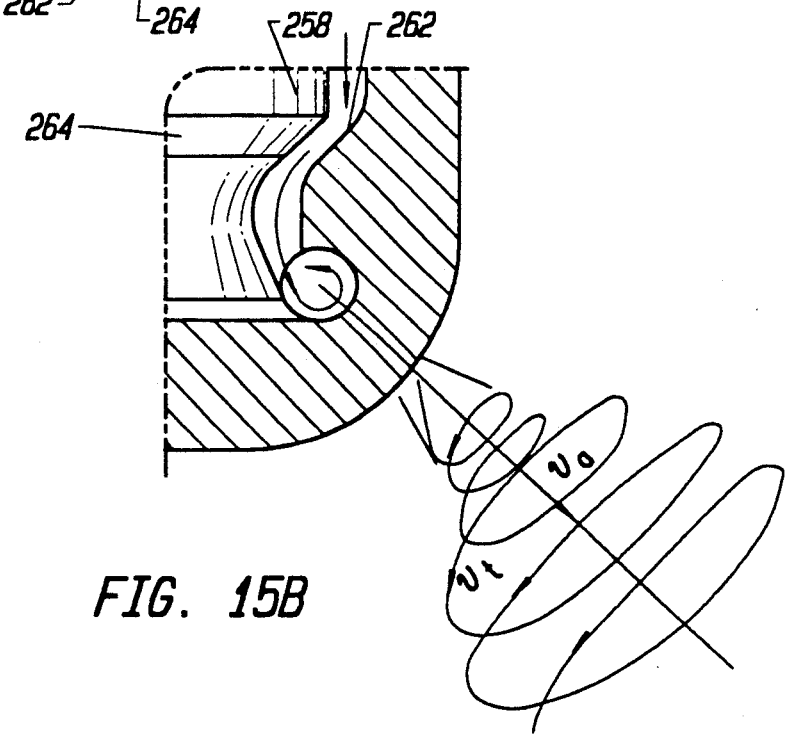
FIG. 15B is an enlarged cross sectional view of a part of the injection nozzle tip of FIG. 15A.

Referring to FIGS. 15A and 15B, another alternate embodiment of a nozzle tip is shown for use of fuel injectors of the type described in this application. Nozzle tip 250 has a tip casing 252 with a blunt end 254 with discharge orifices 256. The tip casing 254 contains a needle valve 258 having an hour glass end configuration 260 that co-operates with an internal complementary surface 262 and the tangentially oriented discharge orifices 256 an explosive discharge spray as schematically illustration in FIG. 15B by the combined centrifugal and axial sectors in parted to the molecules of discharge as they pass at high velocity around an through the discharge orifices. The terminal profile of the needle valve 258 has a peripheral seat segment 264 that contacts the inner casing surface 262 when the needle valve is extended and the nozzle is in its closed position. When the needle valve is lifted by actuator means such as that elsewhere disclosed in this specification, fuel passes around and under the end of the needle valve to enter the discharge orifices 256, which act as a zone of hydrodynamic and centrifugal acceleration to generate ultra high speed rotation in the fuel molecules putting an explosive and ultra dispursive cloud of fuel upon discharge. Regulating the diameter and length of the discharge orifices, the tangential velocity VT and axial velocity VA can be controlled. For example, by increasing the ratio of length L divided by diameter D, the penetration will be increased and the dispersion diminished.

In addition to the unique configuration of the discharge mechanism, the nozzle tip 250 has an internal mechanism to provide a staged discharge of fuel through the discharge orifices 256 as shown in the diagrammatic illustration of FIG. 15C. This stepped profile of the rate of fuel injection for a cycle of operation is accomplished by a metering mechanism 266 formed by inner action of a slide valve segment 268 in the needle valve 258 and a bushing 270 installed in the tip casing 252 in contact with the displaceable needle valve 258. The bushing 270 has a feed passage 272 that communicates with the fuel supply passage 274 for the nozzle tip 250. The feed passage 272 has transfer passages 274 and 276 which selectively align with annular grooves or bypass channels 278 and 280 in the slide valve segment 268 of the needle valve 258. Depending on the position of the needle valve 258, the bypass channels 278 and 280 align with a (peripheral) series of main discharge passages 282 (one shown) or a single small discharge hole 284 that communicates with discharge passages 26 (one shown) that in turn communicates with an accumulator plenum 288 that will release through the discharge orifices 256 when the needle valve is retracted.

In operation, when the needle valve retracts, the discharge hole 284 first communicates with the feed passage 272 and delivers a metered quantity fuel to the accumulator plenum 288 that is released through the discharge orifices 256 as the needle valve lifts its seat segment 264 from the inside surface 262 of the tip casing 254. As the needle valve proceeds in retraction, the multiple main holes 282 communicate with the feed passage 272 through the bypass channels 278 and supply the accumulator plenum 288 with a greater quantity of fuel for discharge through the orifices 256

If desired, this combined pilot and main discharge can be restricted to each cycle of operation or be repeated multiple times by a periodic oscillation of the needle valve to create pulsed discharge as previously described. The nozzle tip of FIGS. 15A-C can be adapted to existing designs of fuel injector nozzles or for the improved nozzles described herein.

Combining the sequenced pilot and main discharge with the dispersion scheme generated by the configuration of needle valve and the orientation of discharge orifices, a dispursive mixture of fuel and air can be provided for non-polluting combustion processes in all types of thermal machines, engines, turbine, boilers, and other devices if efficient combustion is desired.

Figure 16A:
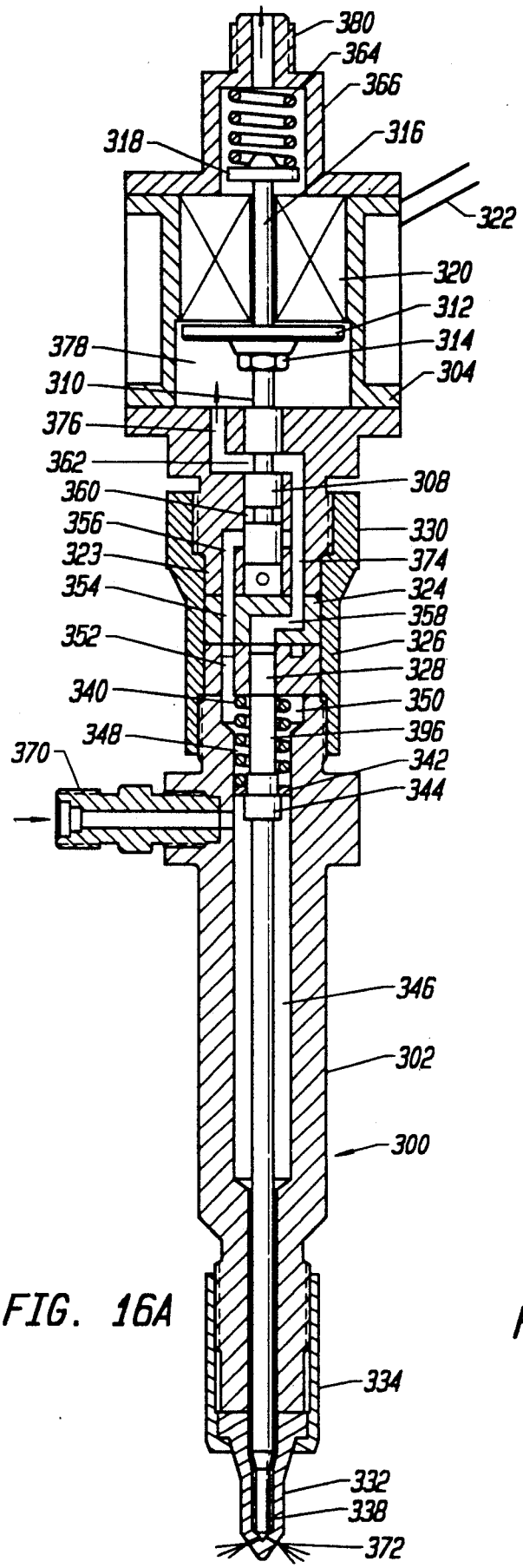
FIG. 16A is a cross sectional view of a fuel injector nozzle in injection mode.
Figure 16B:
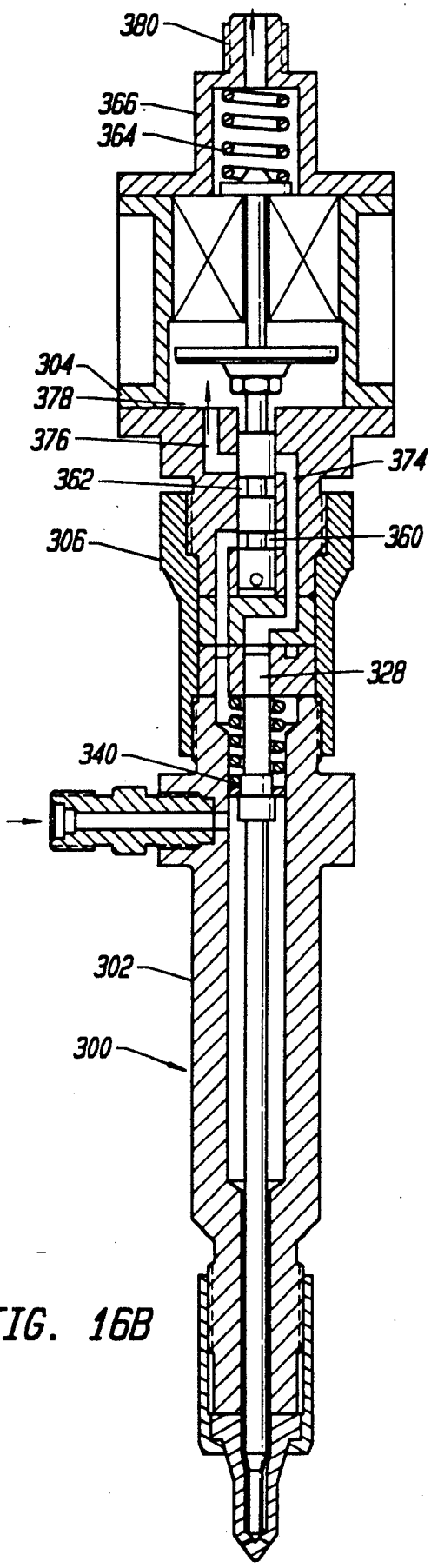
FIG. 16B is the fuel injector of FIG. 16A in inactive mode.

Referring now to FIGS. 16A and 16B, an alternate embodiment of an injector 300 is shown. The injector 300 has an injector body 302 that is connected to an actuator 304 that is preferable of a solenoid type. The solenoid actuator 304 operates to initiate the injection spray when the solenoid actuator 304 is activated. Between the solenoid actuator 304 and the injection body 302 is a slide valve assembly 306 that includes a cylindrical slide valve 308 connected to a shaft 310 having an armature stop 312 with an adjustment nut 314 with an extension armature core 316 and a cap 318. A coil 320 activated by an electronic current through wires 322 displaces the shaft 310 and slide valve 308 which is contained in a distributor housing 323. The distributor housing 323 abuts an adjacent distributor manifold housing 324 which in turn abuts a delivery bushing 326 in which the end of a valve needle 328 is slidably seated. The slide valve assembly 306 is interconnected by a threaded sleeve 330.

The valve needle 328 extends down through the injector body 302 to a nozzle tip 332. The nozzle tip 332 is connected to the injector body 302 by a cap bushing 334. The valve needle 328 has a reduced diameter neck segment 336 and a stepped down diameter end segment 338 which provide sufficient concentric surface areas for actuation of the needle valve by hydraulic pressures differentials that counteract a spring bias generated by a compression spring 340 which is located in the top of the injector body and contained by a porous spring seat 342 mounted against an enlarged segment 344 of the valve needle 328 at one end and the guide bushing 326 at the other end. A series of small holes (not shown) in the porous spring seat 342 allows the injection fluid to pass from a plenum 346 to the spring chamber 348 where the fluid is allowed to pass via a passage 350 to the interconnecting passage 352 in the manifold housing 324. The manifold housing 324 also has a passage 356 that enables injector fluid to be alternately directed to the top of the needle valve 328.

The slide valve 308 in the slide valve assembly 306 has bypass grooves or channels 360 and 362. The channel 360 connects the passages 356, 354, and 352 to the passage 358 leading to the top of the needle valve 328 or is alternately displaced to block this interconnection when the solenoid actuator 304 is activated pulling the armature core 316 and armature stop 312 against the coil 320. The nozzle spray is initiated upon activation of the actuator.

In the deactivated state as shown in FIG. 16B, the slide valve 308 is displaced by the bias of a compression spring 364 in the top cap 366 of the solenoid actuator 304. In this position, the channel 360 allows injector fluid to be directed to the top end of the needle valve 328, such that the needle valve is displaced to a closed position by the bias force of the compression spring 340. The area at the top of the needle valve 328 is approximately equal to the concentric neck-down area of the neck segment 338 plus the step-down area of the step segment 338 such that the needle valve 328 is largely controlled the relatively bias force of the compression spring 340. In this manner, the fuel injector can be operated at extremely high pressures without the requirement of high actuation forces as the hydraulic pressures are largely balanced. Variations in the area ratios can be selected for optimum operation, for example, where the engine combustion pressure is high, the area of the top of the valve needle may be greater than the concentric neck down areas to improve the force of seating.

In operation, injector fluid from a high pressure source such as a high pressure pump (not shown) or accumulator rail (not shown) enters the injector 300 through a supply nipple 370 directly communicates with the plenum 346 and in imperceptively raises the needle valve 328 against the force of the compression spring 340 when the slide valve 308 is in the position shown in FIG. 16A. As noted, back pressure against the valve needle tip is relieved through nipple 380. This allows the injector fluid to be sprayed through jets or orifices 372 in the nozzle tip 332, during actuation of the solenoid actuator 304.

When the solenoid actuator 304 is deactivated and the slide valve 308 is displaced by force of the compression spring 364 to permit the injector fluid to communicate with the top of the needle valve 328, the compression spring 340 and hydraulic pressure force the needle valve 328 down against the inside end of the nozzle tip 332 closing the jet or orifices 372 as shown in FIG. 16B.

During actuation, any fluid that is trapped in the common passage 374 is allowed to escape through groove channel 362 in the slide valve 308 and pass through a return passage 376 to a chamber 378 in the solenoid actuator 304. From the chamber 378 in the solenoid actuator, the fluid returns through a nipple 380 at the top of the cap 366 of the solenoid actuator to the low pressure side of the fluid pump (not shown).

Figure 17:
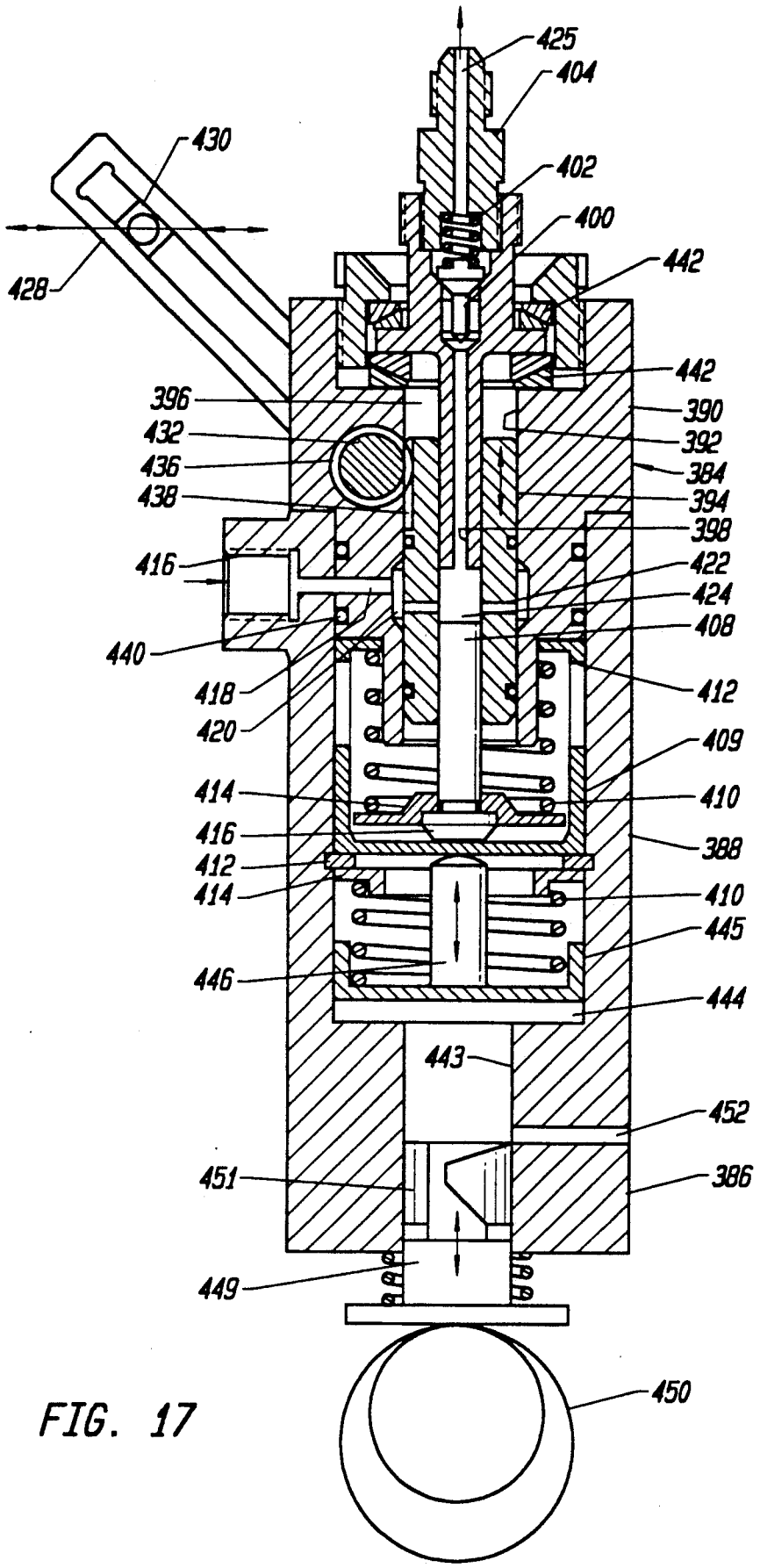
FIG. 17 is a cross sectional view of a high pressure fuel pump and power booster.

Referring now to FIG. 17, a high pressure fuel pump 384 is shown in combination with a hydraulic booster 386. The high pressure fuel pump 384 and hydraulic booster 386 have a common high pressure housing 388. The fuel pump 384 can be used without the hydraulic booster 386, however, to achieve the super high pressures necessary for injection into engines having high pressure combustion chambers, a booster may be necessary to achieve pressure between 50,000 psi and 100,000 psi.

The fuel pump 384 includes a pump body 390 have a generally cylindrical internal slide cylinder 392 having a slider sleeve 394 with an internal, static discharge piston 396 at one end with a narrowed internal discharge passage 398 and a check valve 400 biassed by a compression spring 402, seated in a discharge nipple 404. The discharge nipple 404 is connected to a fuel injector, or an accumulator rail where multiple injectors are serviced by one or more fuel pumps. Distributor means as described hereafter may be included to efficiently regulate the injection to one or more injectors.

At the opposite end of the slide sleeve 394, is a displaceable piston 408. The displaceable piston 408 is actuated in the slider sleeve 394 by any conventional actuator that acts on a slidable end cup 409 against the bias of a compression spring 410 that is seated on a bushing 412 and a spring stop 414 connected to the end of the piston 408 and secured by an end stop 416. Low pressure fuel which may be prepressurized, enters a side orifice 416 in the side of the common housing 388 and passes through a passage 418 in the pump body to annular chamber 420 that communicates with a narrow opposed entry passages 422 to the prime pump chamber 424.

Upon displacement of the piston 408 the end of the piston blocks the chamber 424 communication with the supply passages 422 and pressurizes the entrapped fuel with a pressure that causes retraction of the check valve 400 against spring 402 and injects a pulse of fuel through a discharge passage 425 in the discharge nipple 404.

In order to vary the effective volume that is compressed and displaced by the piston 408, the slider sleeve 394 is controllably displaceable in the guide cylinder 392 by a manual control lever 428. The control lever 428 may be operated by a reciprocal control device (shown in FIG. 20) that engages a slidable point journal 430 to translate the reciprocal action of the control mechanism to the angular actuation of the lever 428. The lever 428 is connected to a bearing journal 432 having a gear 436 that engages a machined rack 438 in the outside of the slider sleeve 394. Upon rotation of the gear 436, the slider sleeve 394 is displaced toward or away from the discharge nipple 404. In this manner, the communicating supply passages 422 to the compression chamber 426 are altered in position such that piston 408 eclipses the side passages 422 at different positions in its stroke. This varies the displaceable volume of fuel in the pump chamber 424.

The body 390 of the high pressure fuel pump 384 is constructed to withstand the high internal pressures of the pressurized hydraulic fuel and includes the necessary O-rings 440 and double, beveled compression rings 442 to seal the slidable and static parts forming the fuel pump.

In order to further increase the delivered pressure of the pumped fuel, the hydraulic booster 386 is coupled to the fuel pump 384. The hydraulic booster 386 has a large internal cylinder 443 that communicates with an enlarged cylinder 444 with a slidable end cap 445 with an inner boss 446 that contacts the end cup 409 and hydraulically displaced the piston-like end cup 409 and thereby displaced &:he internal piston 408 of the fuel pump. The hydraulic booster 386 includes a piston-like end cup 447 that is displaceable in the cylinder 444 against a compression spring 448 by actuation of a hydraulic pump piston 449 piston by a cam 450. The piston 449 includes a helically wrapped shield 451 that alters the effective displacement volume of the piston 449 on rotation of the piston on its axis by a control means (not shown). A hydraulic fluid supply passage 452 is connected to a low pressure fluid supply (not shown) and communicates with the cylinder 443 to supply hydraulic motive fluid that is acted on by the piston. The wrapped shield 451 eclipses the side passage 452 at different points in the displacement of the piston depending on the orientation of the wrapped shield. As the resulting hydraulic pressure is dependent on the cross sectional area of the pistons with relationship to the ultimate discharge passage, compounding can be effected by relative cross sectional area of the hydraulic chamber 444 to the discharge passage 398 of the piston chamber 424. Added amplification by a factor of 10 can be accomplished utilizing the hydraulic booster.

Figure 18:
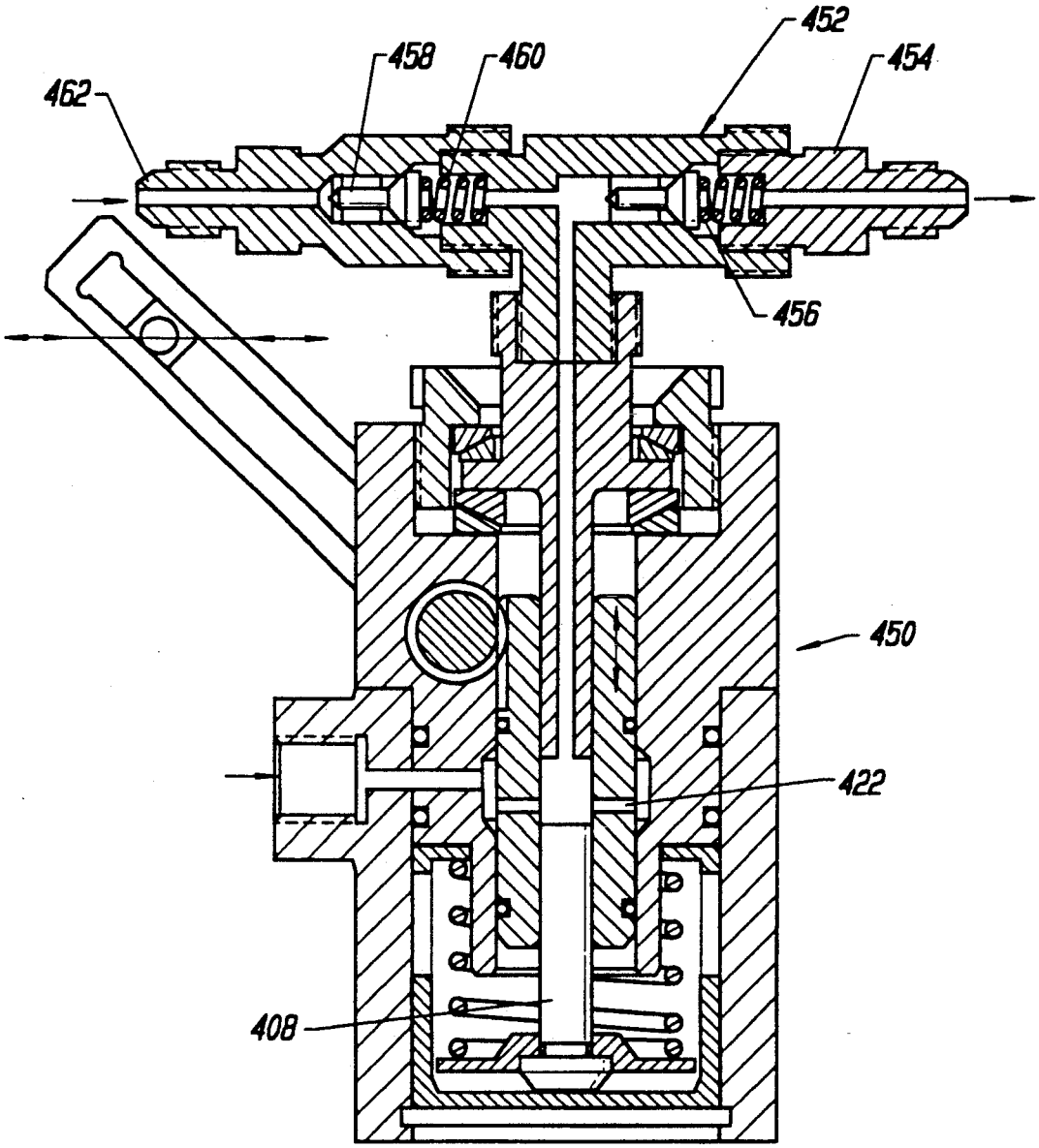
FIG. 18 is a cross sectional view of a modified high pressure fuel pump.

Referring now to FIG. 18, the modified high pressure fuel pump 450 is shown without the use of a hydraulic booster, but with a modified discharge assembly 452. The discharge assembly 452 includes a discharge nipple 454 having a spring bias check valve assembly 456, similar to that previously disclosed. In addition, the assembly 452 includes a vacuum relief valve 458 that is biassed by a spring 460 in a manner similar to the check valve assembly 456. In this configuration, when the piston 408 is retracted, the vacuum created before the supply passages 422 are exposed by the retracting piston 408 to again provide a conduit communication with the fuel supply, the check valve 458 is displaced by the pressure of the alternate fuel line connection nipple 462. In this manner, the efficiency of the pump 450 can approximate 100% and eliminate any potential vapor formation generated from the vacuum. The alternate high pressure fuel pump 450 can be coupled to a hydraulic booster as described with relation to FIG. 17.

Referring now to FIG. 19, a schematic illustration of a pressurized accumulator rail 480 is shown with a feedback, control mechanism 482. The accumulator rail 480 receives fuel from a high pressure fuel pump through line 484. The fuel is supplied to one or more fuel injectors (not shown) through discharge line 486. The rail 480 acts as a distributor manifold and a fluid surge chamber in order to minimize the affect of fluctuations in pressure resulting from variations in fuel supply and injector demand. The feed back mechanism 482 is constructed with a valve plunger 488 in a cylinder 490 displaceable between stops 492 and 494 and biased by compression spring 496.

A conduit 498 communicates between the rail discharge line 486 and the chamber 490 in the feed back mechanism 482. The developed pressure in the chamber 500 opposes the force of the compression spring 496 to locate the position of the valve plunger 488 within the cylinder 490. The valve plunger 488 has a series of groove channels 502, 504, 506, and 508. Depending on the position of the valve plunger 488, the channels selectively provide a passage for feed lines 510 and 512 that connect the high pressure rail 480 to one side or the other of a double chamber cylinder 518 divided by a slidable piston 520. Similarly, channels 502 and 508 selectively connect the chambers 514 and 516 of cylinder 518 to a low pressure supply (not shown) via return lines 526 and 528. The chamber 518 is sealed at its ends with allowance for passage of a slide rod 522 connected to each end of the moveable piston 520. Mounted on the slide rod is a bracket 524 which connects to the slide journal 430 in the lever 428 of the fuel pump in FIG. 17.

In operation, the fuel pressure in the chamber 500 of the cylinder 590 determines the location of the valve plunger 488. For example, upon an increased power demand the fuel injector nozzles generally inject a greater quantity of fuel resulting in a pressure loss in the rail. Thus, at the very time that more fuel is needed and often when the combustion pressures in the combustion chamber have increased, the fuel supply to the injector has a reduced pressure. The feed back mechanism 482 described, solves this problem by sensing a pressure drop in injector supply line 486 which causes the plunger 488 to move away from the compression spring 496 by action of the force of the compression spring thereby aligning groove 508 with low pressure return line 528 and aligning groove 504 with high pressure supply line 510 such that the chamber 514 fills with additional fluid and the chamber 516 is drained of some fluid as the piston 52 displaces in the cylinder 518. This displacement thereby actuates the lever 428 in FIG. 17.

Referring now to FIGS. 20A and 20B, a one plunger injector distributor designated in general by the reference numeral 540 is shown schematically. In FIG. 20A, the injector distributor 540 is shown connected with a typical fuel injector 542. The injector distributor 540 has a displaceable valve plunger 544 contained in a cylinder 546. The plunger 544 is biased toward a solenoid actuator mechanism 548 by a compression spring 550. Actuation of the solenoid actuator displaces the plunger 544 compressing the compression spring 548 aligning a first set of passages 552, 554, 556, and 558 with groove channels 560 and 562 in the plunger. The first passages 552 and 554 in the cylinder housing 561 supply high pressure fuel through channel 560 to the injector passage 570 to the injector 542 for injection.

Referring to FIGS. 20A and 20B, it is to be understood that in each of the high pressure hydraulic pumps, injectors and distributors where a slide valve is employed, the high pressure supply and discharge passages are comprised of opposed inlets, for example, 574 or opposed outlets 576 as shown in the cross sectional view of the cylinder housing 561 as shown in FIG. 20B. This arrangement cancels the high pressure force that is applied to the cylindrical slide element that would otherwise force the slide element hard against the opposite side of the cylinder wall thereby substantially increasing the force required to displace the element because of frictional resistance. Offset angled drill holes appropriately direct the passages without intersection. As the mechanisms described herein are required to be extremely reactive and actuate to maximum cycle time, this feature is important to overcome hydraulically generated resistance in the sliding components. The slide elements float on a hydraulic fluid film for high-speed actuation.

In the actuated position, the high pressure source 568 is connected to passages 552 and 554 and bypass channel 560 to a common feed line 571 to the supply passage 570 of the fuel injector 542. The high pressure fuel raises the needle valve 572 of the fuel injector 542 against a compression spring 574 allowing hydraulic fuel to be discharged from the nozzle jets 576.

Hydraulic fuel trapped in a chamber 578 of the fuel injector 542 is allowed to escape through passage 579 common return line 581 though passage 558 and aligned bypass channel 562 to return line 556 to the low pressure fuel supply source.

In the deactivated position, the plunger 544 is displaced by the compression spring 550 to the actuator aligning certain passages with select bypass channels in the plunger. In the deactivated position, feed passage 586 is aligned with bypass channel 590 to cause fluid to pass through passage 588 in common feed line 581 to the injector chamber 578. The high pressure hydraulic fuel in the chamber 578 acts on the end of the valve needle 572 to force the end of the valve needle hard against the injector tip blocking the discharge jets 576. Fuel that is trapped in the injector 542 is allowed to escape through the supply passage 570 and the common feed line 571 through passage 594 and bypass channel 596 to low pressure turn passage 592.

Displacement of the plunger 544 can be positioned by hydraulic damper 580 having a piston extension 584 connected to the actuator that eclipses a side bleed passage 582 and compresses hydraulic fuel in a chamber 585.

The improvements to the high pressure fuel injection nozzle system of this invention provide for greater flexibility in the design of a custom profile, high-pressure fuel pulse. Because operation cf a diesel engine at a high speed interferes with proper timing of the injection pulses because of limited pulse duration, slight lag in developing and relaxing the electro-magnetic field of the solenoid actuator in initiating the pulse and terminating the pulse, distorts the pulse profile at high speed. By using a pair of distributor components operated in tandem to supply a single nozzle component with fuel on alternate cycles, the effective operating speed of the engine can be double the limits for an engine with a injector nozzle connected to an individual distributor component.

Referring now to FIGS. 21A–D, a schematic illustration of a high speed tandem injector distributor is shown and designated generally by the reference numeral 600. The injector distributor 600 is connected to a fuel injector 610. The tandem injector distributor 600 has a first plunger 602 and a second plunger 604 in respective cylinders 606 and 608. The cylinders 606 and 608 are in a distributor housing (not shown) in which are mounted double acting, push-pull actuators 612 and 614. The actuator 612 and 614 are connected to the plungers 602 and 604 to selectively displace the plungers in either direction to align select bypass channels in the plungers with fuel lines that connect a high pressure fuel pump 616 to the injector 610.

As previously discussed, each of the entry and return lines to the bypass channels are constructed as opposed entry passages to cancel any hydraulic forces that may be developed by the high pressure hydraulic fluid entering or leaving the side entry passages acting against the plungers.

Figure 21A:
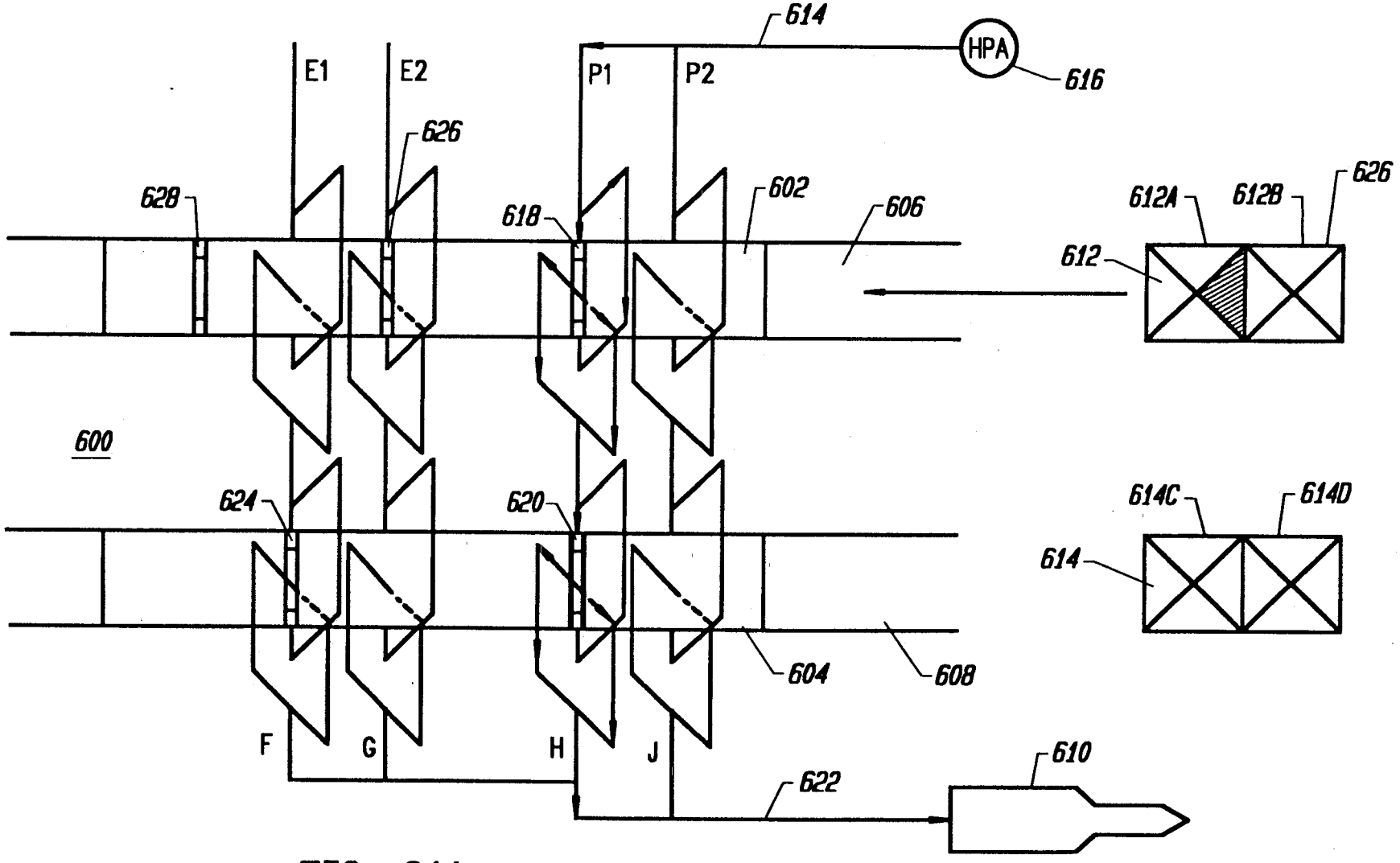
FIG. 21A is a schematic illustration of a tandem fuel distributor in a first sequence of operation.

As shown in FIGS. 21A–21D, a sequential operation of the tandem injector distributor 600 is demonstrated. In FIG. 21A, injection is initiated by actuation of plunger 602 by push actuator 612 upon activation of coil 612A. Plunger 602 is displaced such that bypass channel 618 is aligned with high pressure line P1 to supply high pressure fuel through the this part of the tandem injector distributor. Plunger 604 remains in its previously existing position positioned such that bypass channel 620 is aligned with injector supply line H allowing feed of high pressure fuel to the injector 610 through common line 622.

Figure 21B:
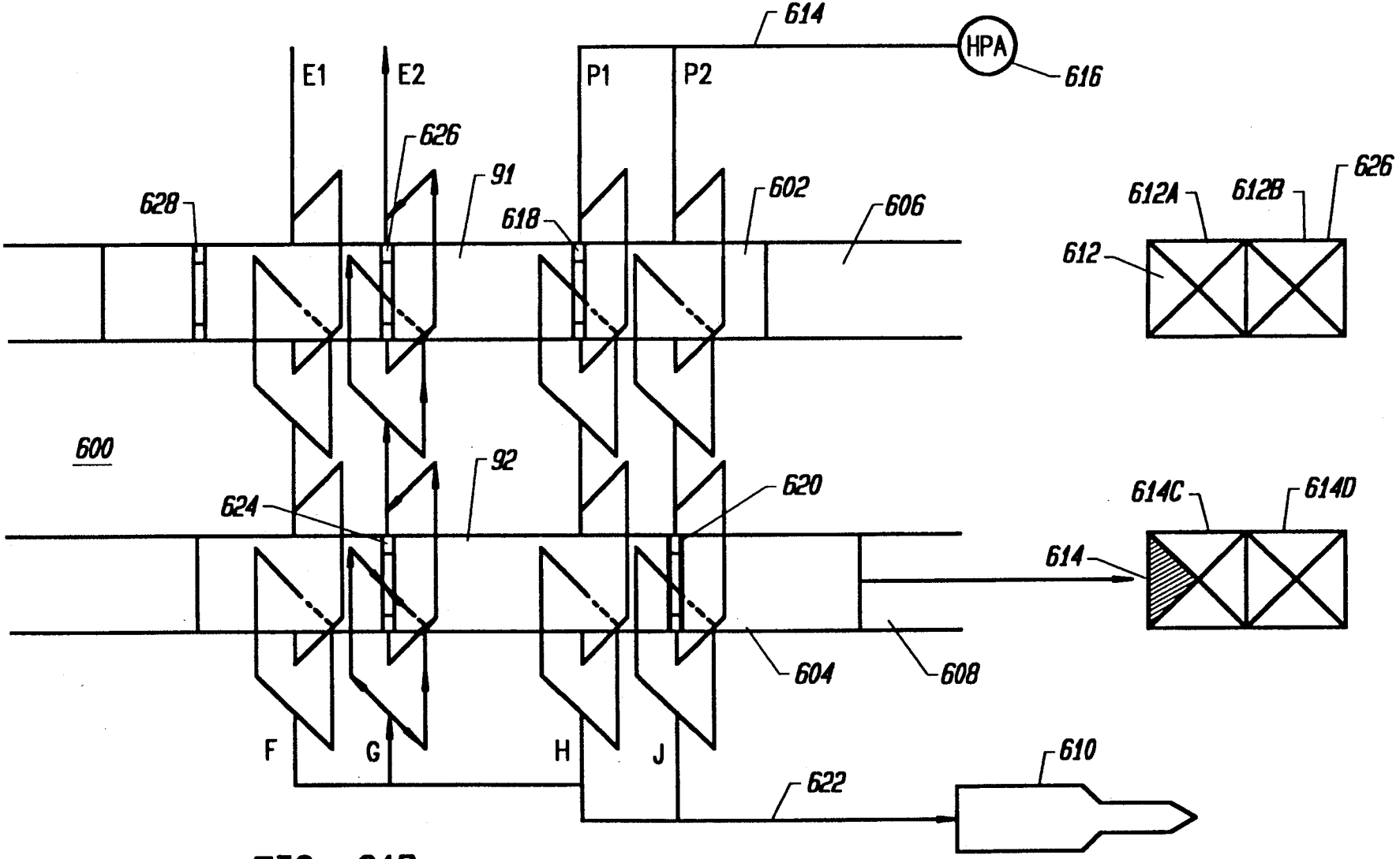
FIG. 21B is a schematic illustration of the tandem distributor of FIG. 21A in a second sequence of operation.

In the sequence of FIG. 21B, the injection time is terminated by actuation of actuator 614 by activation of coil 614C to pull the plunger 604, such that low pressure return line G from common connecting line 622 is aligned with bypass channel 624. The plunger 602 remains in its displaced position as in the first sequence with bypass channel 626 aligned with exit line E2 cutting off the high pressure feed to the injector and allowing return of displaced fuel by the seating valve needle of the injection.

Figure 21C:
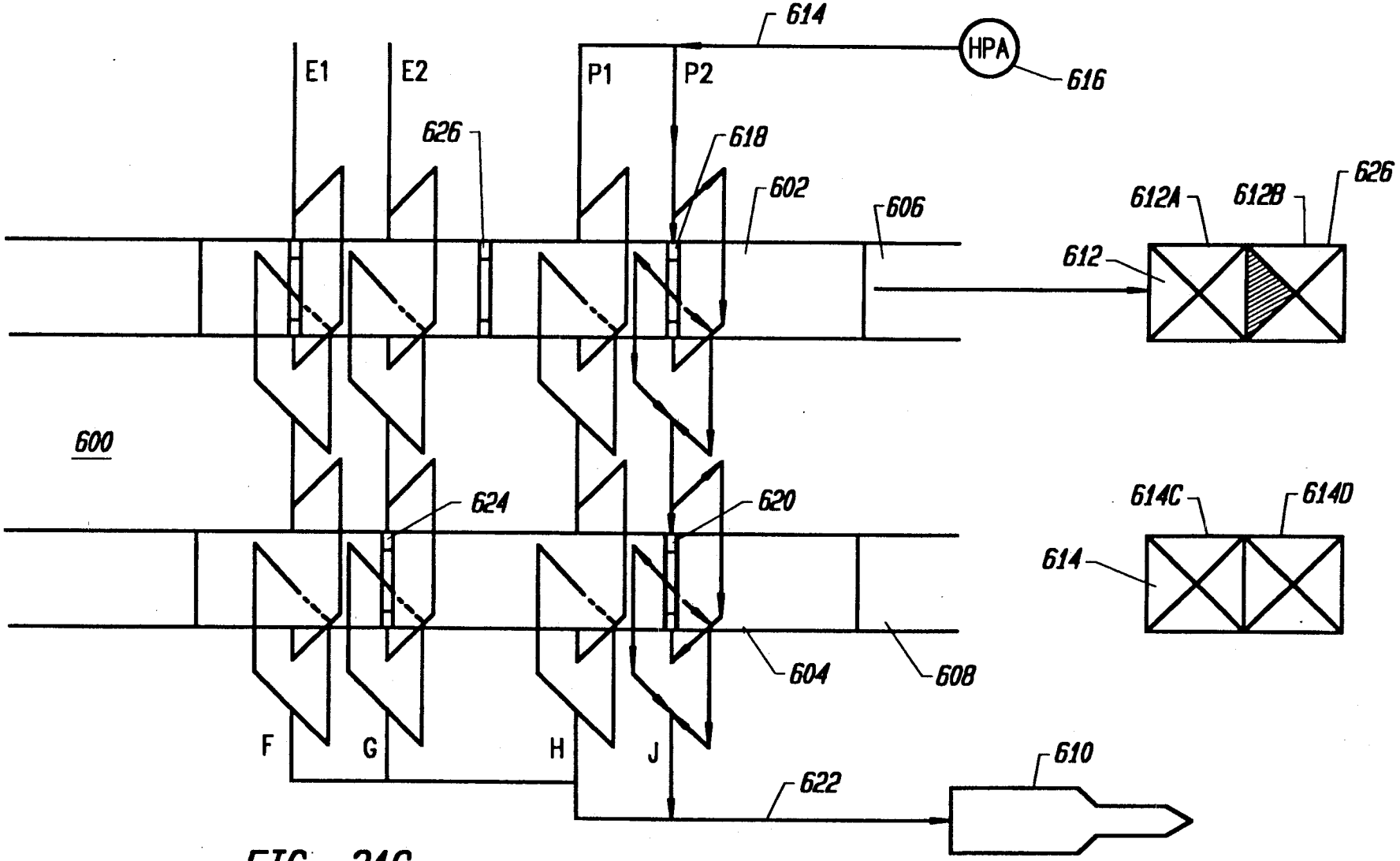
FIG. 21C is a schematic illustration of the tandem distributor of FIG. 21A in a third sequence of operation.

In the sequence shown in FIG. 21C, coil **612*b* of actuator 612 is activated, pulling plunger 602 such that the bypass channel 618 now aligns with high pressure feed line P2. Plunger 604 remains in its former position with bypass channel 620 aligned with high pressure feed line J providing connection to common feed line 622 allowing passage of fuel from the fuel pump 616 to the injector 610** for another injection cycle.

Figure 21D:
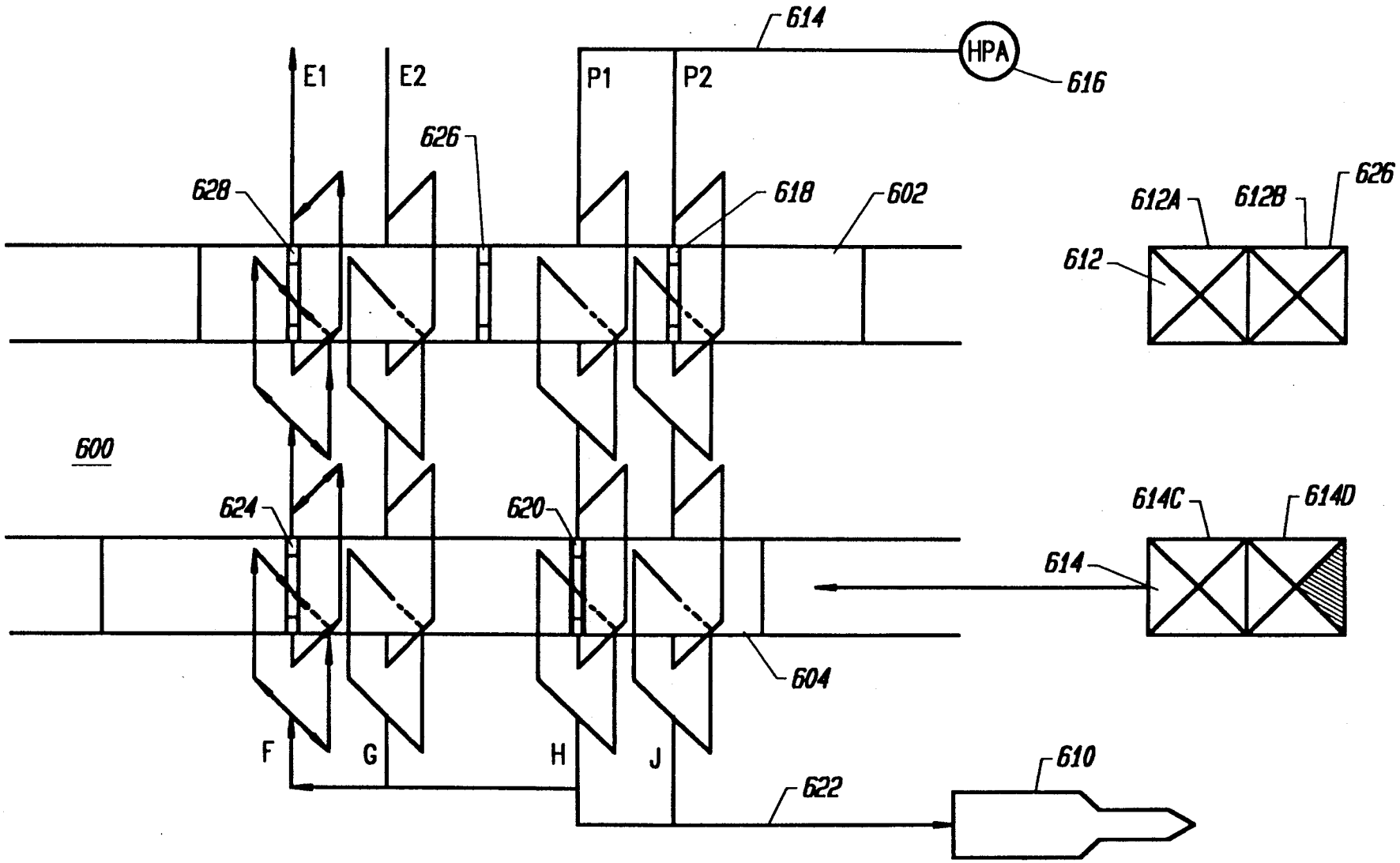
FIG. 21D is a schematic illustration of the tandem distributor of FIG. 21A in a fourth sequence of operation.

Referring now to FIG. 21D, coil 614D of actuator 614 is activated displacing plunger 604 such that return line F is aligned with bypass passage 624. Plunger 602 remains in its former position with bypass channel 628 aligned with exit line El allowing the hydraulic pressure of the fuel to be relaxed by closing the injector and releasing displaced fluid on closure.

For each cycle of coil activation, two cycles of injection have occurred, this allows speeds of an engine equipped with the tandem injected distributor to be doubled. In general, cycle speeds are inhibited by the inherent delays in electronic solenoid-type actuators in building up and relaxing the electromagnetic fields necessary to displace a linear armature. The tandem distributor doubles the potential operating speeds.

Figure 22:
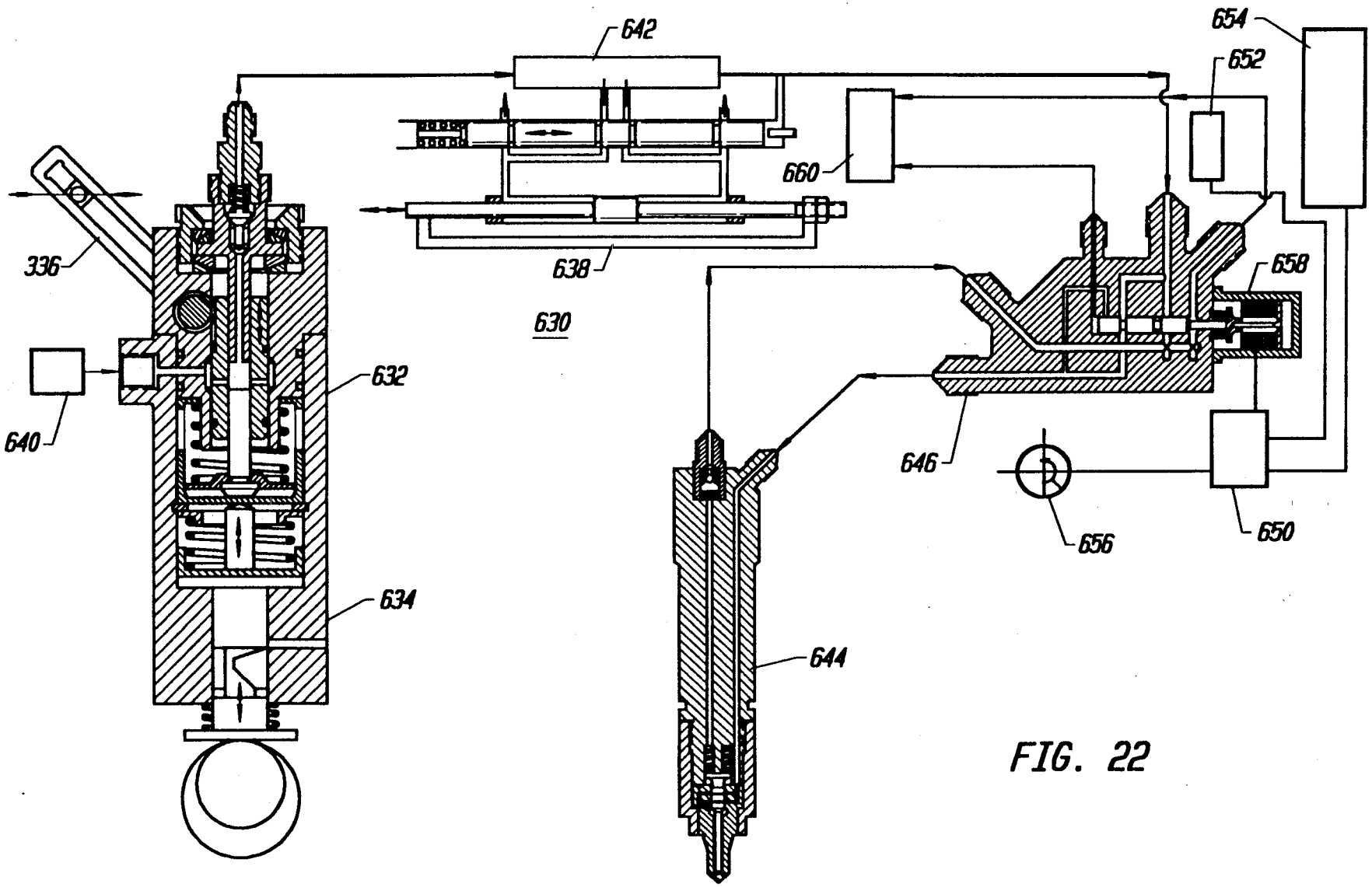
FIG. 22 is a schematic illustration of a fuel injector system utilizing multiple components.

Referring now to FIG. 22, a fuel injection system 610 is shown with an integration of certain of the components previously described. The system includes the high pressure pump 632, described with reference to FIG. 17. The pump 632 is equipped with the booster 634, as described, and a displacement control lever 636 connected to the pressure regulator 638, disclosed with reference to FIG. 19. Pressurized fuel supplied by the fuel pump 632 from a fuel supply 640 is pumped to a high pressure rail 642 regulated by the regulator 638. From the rail 642, the fuel is injected to a fuel injector 644, of the type disclosed in FIG. 12, and is regulated by a distributor component 646, of the type shown in FIG. 8A and 8B.

An electronic control module 650 receives input from engine sensors 652 and coordinates the pressure and pulse length of injected fuel with the engine operating cycle as detected by a sensor 656. The control module activates the actuator 658 of the distributor 646 to precisely control the cycle of injection and coordinate the cycle of injection with the operating cycle of the engine. Fuel displaced from the distributor during cycling is delivered to a low pressure source 660 that may be identical with the fuel supply source 640 to the high pressure fuel pump 632. It is to be understood that the fuel supplies 640 and 660 can be an intermediate pressurized supply that is fed by a low pressure fuel pump such that fuel delivered to high pressure fuel pump 632 is previously pressurized.

The injection system of this invention can use substitute components that are either of a conventional type or of the alternate embodiments described in this application. The preferred use of the components described enables close and precise control over the pressure and time of fuel injections and allows specific fuel delivery profiles to be developed according to the design requirements for the particular engine or thermal combustor used with this injection system. The injection system is operable with high speed engines and may be operable with two-cycle or four-cycle engines for precision injection during the brief angular window for injection in high speed cycled operations.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A fuel injector system comprising:

a) a high pressure fuel pump, the high pressure fuel pump having, a pump housing having an internal, cylindrical slider sleeve with first and second ends, the slider sleeve having a discharge passage assembly in the first end for discharging fuel at high pressure from the pump, and a slidable piston in the second end wherein the piston has an end, and a fuel chamber is formed between the end of the piston and the discharge assembly;

a fuel passage means for supplying fuel to the pump, the fuel passage means including at least one side entry passage to the fuel chamber;

actuator means for reciprocating the piston in the sleeve, wherein fuel is supplied to the chamber through the side entry passage and the piston eclipses the side entry passage on displacement by the actuator means, pumping the fuel in the chamber through the discharge passage assembly, the discharge passage assembly including a check valve means for preventing discharged fuel from reentering the fuel chamber, wherein the fuel passage assembly has a stationary discharge tube mounted to the pump housing with an internal passage, the tube being inserted into the first end of the slider sleeve, wherein the housing has an internal cylinder and the slider sleeve is displaceable in the cylinder, the pump having actuating means engaging the slider sleeve for displacing the slider sleeve in the internal cylinder, wherein the volume of fuel displaced by the piston is varied according to the position of the slider sleeve in the housing cylinder; and, b) a booster pump, the booster pump having, a housing connected to the pump housing, a booster cylinder with a slidable booster piston in the cylinder, the cylinder in part forming a booster hydraulic chamber, a booster actuator means for reciprocating the booster piston in the booster cylinder, a displaceable end member in engagement with the slidable piston of the fuel pump, the end member being in hydraulic communication with the hydraulic chamber, wherein the end member and the fuel pump piston have different diameters and the diameter of the end member of the booster pump substantially exceeds the diameter of the fuel pump piston, wherein on reciprocation of the booster piston with hydraulic fluid in the booster chamber the fuel pump piston is displaced, said booster pump comprising the actuator means of the fuel pump.

2. The fuel injector system of claim 1 wherein the fuel passage means has first and second, diametrically opposed, side entry passages to the chamber.

3. The fuel injection system of claim 1 wherein the fuel passage means has a stationary discharge tube mounted to the pump housing with an internal passage, the tube being inserted into the first end of the slider sleeve, wherein the housing has an internal cylinder and the slider sleeve is displaceable in the cylinder, the pump having actuating means engaging the slider sleeve for displacing the slider sleeve in the internal cylinder, wherein the volume of fuel displaced by the piston is varied according to the position of the slider sleeve in the housing cylinder.

4. The fuel injector system of claim 1 wherein the actuating means comprises a control lever pivotally connected to the housing by a journal, the slider sleeve having a rack and a lever having a gear fixed to the journal in engagement with the rack wherein on angular displacement of the lever, the slider sleeve is linearly displaced.

5. The fuel injector system of claim 1 wherein the booster pump has adjustment means for varying the volume of fluid displaceable by the booster piston.

6. The fuel injector system of claim 5 wherein the booster actuator means comprises a rotating cam in engagement with the booster piston to displace the booster piston in a first direction and a compression spring in engagement with the booster piston to displace the booster piston in a second direction.

7. The fuel injector system of claim 1 wherein the hydraulic chamber has a first section forming the booster cylinder and an enlarged, cylindrical second section in which the end member of the booster pump is displaceable.

* * * * *